US008734094B2

(12) United States Patent
Wallace et al.

(10) Patent No.: US 8,734,094 B2
(45) Date of Patent: May 27, 2014

(54) FAN ASSEMBLY

(75) Inventors: John David Wallace, Malmesbury (GB); Chang Hin Choong, Johor Bahru (MY)

(73) Assignee: Dyson Technology Limited, Malmesbury, Wiltshire (GB)

( * ) Notice: Subject to any disclaimer, the term of this patent is extended or adjusted under 35 U.S.C. 154(b) by 341 days.

(21) Appl. No.: 13/189,012

(22) Filed: Jul. 22, 2011

(65) Prior Publication Data

US 2012/0031509 A1 Feb. 9, 2012

(30) Foreign Application Priority Data

Aug. 6, 2010 (GB) ..... 1013265.2

(51) Int. Cl.
*F04D 25/08* (2006.01)

(52) U.S. Cl.
USPC ..... 415/175

(58) Field of Classification Search
USPC ..... 415/144, 175; 137/338, 339
See application file for complete search history.

(56) References Cited

U.S. PATENT DOCUMENTS

| | | | |
|---|---|---|---|
| 1,357,261 | A | 11/1920 | Svoboda |
| 1,767,060 | A | 6/1930 | Ferguson |
| 1,896,869 | A | 2/1933 | Larsh |
| 1,961,179 | A | 6/1934 | Tinkham |
| 2,014,185 | A | 9/1935 | Martin |
| 2,035,733 | A | 3/1936 | Wall |
| 2,071,266 | A | 2/1937 | Schmidt |
| D103,476 | S | 3/1937 | Weber |
| 2,115,883 | A | 5/1938 | Sher |
| D115,344 | S | 6/1939 | Chapman |
| 2,210,458 | A | 8/1940 | Keilholtz |
| 2,258,961 | A | 10/1941 | Saathoff |
| 2,295,502 | A | 9/1942 | Lamb |
| 2,336,295 | A | 12/1943 | Reimuller |
| 2,363,839 | A | 11/1944 | Demuth |
| 2,433,795 | A | 12/1947 | Stokes |
| 2,473,325 | A | 6/1949 | Aufiero |

(Continued)

FOREIGN PATENT DOCUMENTS

| | | |
|---|---|---|
| BE | 560119 | 8/1957 |
| CA | 1055344 | 5/1979 |

(Continued)

OTHER PUBLICATIONS

Gammack, P. et al., U.S. Office Action mailed Jun. 8, 2012, directed to U.S. Appl. No. 12/230,613; 15 pages.

(Continued)

*Primary Examiner* — Edward Look
*Assistant Examiner* — Liam McDowell
(74) *Attorney, Agent, or Firm* — Morrison & Foerster LLP

(57) ABSTRACT

A fan assembly includes a motor-driven impeller for creating an air flow, at least one heater for heating a first portion of the air flow, a surface diverting a second portion of the air flow away from said at least one heater, and a casing comprising at least one first air outlet for emitting the first portion of the air flow and at least one second air outlet from emitting the second portion of the air flow. To cool an external surface of the casing, at least one second air outlet is arranged to direct at least part of the second portion of the air flow over the external surface.

30 Claims, 12 Drawing Sheets

(56) References Cited

U.S. PATENT DOCUMENTS 2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,729,934 A * 5/1973 Denning et al. ..... 60/226.2
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,090,814 A 5/1978 Teodorescu et al.
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,734,017 A 3/1988 Levin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger, IV
5,061,405 A 10/1991 Stanek et al.
D325,435 S 4/1992 Coup et al.
5,110,266 A 5/1992 Toyoshima et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,435,489 A 7/1995 Jenkins et al.
5,449,275 A 9/1995 Gluszek et al.
5,518,370 A 5/1996 Wang et al.
5,609,473 A 3/1997 Litvin
5,645,769 A 7/1997 Tamaru et al.
5,649,370 A 7/1997 Russo
5,671,321 A 9/1997 Bagnuolo
5,735,683 A 4/1998 Muschelknautz
5,762,034 A 6/1998 Foss
5,762,661 A 6/1998 Kleinberger et al.
5,783,117 A 7/1998 Byassee et al.
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,241,600 B1 6/2001 Uehara
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
6,604,694 B1 8/2003 Kordas et al.
D485,895 S 1/2004 Melwani
6,789,787 B2 9/2004 Stutts
6,791,056 B2 9/2004 VanOtteren et al.
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,192,258 B2 3/2007 Kuo et al.
7,412,781 B2 8/2008 Mattinger et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,660,110 B2 * 2/2010 Vinson et al. ..... 361/679.47
7,664,377 B2 2/2010 Liao
D614,280 S 4/2010 Dyson et al.
7,731,050 B2 6/2010 Parks et al.
7,775,848 B1 8/2010 Auerbach
7,806,388 B2 10/2010 Junkel et al.
7,841,045 B2 11/2010 Shaanan et al.
8,002,520 B2 * 8/2011 Dawson et al. ..... 415/144
8,029,244 B2 10/2011 Dumas et al.
8,092,166 B2 1/2012 Nicolas et al.
8,152,495 B2 4/2012 Boggess, Jr. et al.
8,246,317 B2 8/2012 Gammack
2002/0106547 A1 8/2002 Sugawara et al.
2003/0059307 A1 3/2003 Moreno et al.
2003/0164367 A1 9/2003 Bucher et al.
2003/0171093 A1 9/2003 Gumucio Del Pozo
2003/0190183 A1 10/2003 Hsing
2003/0234630 A1 12/2003 Blake
2004/0022631 A1 2/2004 Birdsell et al.
2004/0049842 A1 3/2004 Prehodka
2004/0106370 A1 6/2004 Honda et al.
2004/0149881 A1 8/2004 Allen
2005/0031448 A1 2/2005 Lasko et al.
2005/0053465 A1 3/2005 Roach et al.
2005/0069407 A1 3/2005 Winkler et al.
2005/0128698 A1 6/2005 Huang
2005/0163670 A1 7/2005 Alleyne et al.
2005/0173997 A1 8/2005 Schmid et al.
2005/0281672 A1 12/2005 Parker et al.
2006/0172682 A1 8/2006 Orr et al.
2006/0199515 A1 9/2006 Lasko et al.
2006/0263073 A1 11/2006 Clarke et al.
2006/0279927 A1 12/2006 Strohm
2007/0035189 A1 2/2007 Matsumoto
2007/0041857 A1 2/2007 Fleig
2007/0065280 A1 3/2007 Fok

(56) References Cited

U.S. PATENT DOCUMENTS

| | | | |
|---|---|---|---|
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0269323 | A1 | 11/2007 | Zhou et al. |
| 2008/0020698 | A1 | 1/2008 | Spaggiari |
| 2008/0124060 | A1 | 5/2008 | Gao |
| 2008/0152482 | A1 | 6/2008 | Patel |
| 2008/0166224 | A1 | 7/2008 | Giffin |
| 2008/0286130 | A1 | 11/2008 | Purvines |
| 2008/0314250 | A1 | 12/2008 | Cowie et al. |
| 2009/0026850 | A1 | 1/2009 | Fu |
| 2009/0032130 | A1 | 2/2009 | Dumas et al. |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0120925 | A1 | 5/2009 | Lasko |
| 2009/0191054 | A1 | 7/2009 | Winkler |
| 2009/0214341 | A1 | 8/2009 | Craig |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2010/0256821 | A1 | 10/2010 | Jeung et al. |
| 2011/0058935 | A1 | 3/2011 | Gammack et al. |
| 2011/0070084 | A1 | 3/2011 | Kuang |
| 2011/0110805 | A1 | 5/2011 | Gammack et al. |
| 2011/0123181 | A1 | 5/2011 | Ariga |
| 2011/0164959 | A1 | 7/2011 | Fitton et al. |
| 2011/0198340 | A1 | 8/2011 | Zimmer et al. |
| 2011/0223014 | A1 | 9/2011 | Crawford et al. |
| 2011/0223015 | A1 | 9/2011 | Gammack et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0114513 | A1 | 5/2012 | Simmonds et al. |
| 2012/0230658 | A1 | 9/2012 | Fitton et al. |
| 2012/0308375 | A1 | 12/2012 | Gammack |
| 2013/0026664 | A1 | 1/2013 | Staniforth et al. |
| 2013/0028763 | A1 | 1/2013 | Staniforth et al. |
| 2013/0028766 | A1 | 1/2013 | Staniforth et al. |
| 2013/0129490 | A1 | 5/2013 | Dos Reis et al. |
| 2013/0161842 | A1 | 6/2013 | Fitton et al. |
| 2013/0199372 | A1 | 8/2013 | Nock et al. |
| 2013/0272685 | A1 | 10/2013 | Leow et al. |
| 2013/0272858 | A1 | 10/2013 | Stickney et al. |
| 2013/0280051 | A1 | 10/2013 | Nicolas et al. |
| 2013/0280061 | A1 | 10/2013 | Stickney |
| 2013/0280096 | A1 | 10/2013 | Gammack et al. |
| 2013/0280099 | A1 | 10/2013 | Park et al. |

FOREIGN PATENT DOCUMENTS

| | | | |
|---|---|---|---|
| CA | 2155482 | | 9/1996 |
| CH | 346643 | | 5/1960 |
| CN | 2085866 | | 10/1991 |
| CN | 2111392 | | 7/1992 |
| CN | 1437300 | | 8/2003 |
| CN | 2650005 | | 10/2004 |
| CN | 2713643 | | 7/2005 |
| CN | 1680727 | | 10/2005 |
| CN | 2833197 | | 11/2006 |
| CN | 201180678 | | 1/2009 |
| CN | 201221477 | | 4/2009 |
| CN | 201281416 | | 7/2009 |
| CN | 201349269 | | 11/2009 |
| CN | 101749288 | | 6/2010 |
| CN | 201502549 | | 6/2010 |
| CN | 101825103 | A | 9/2010 |
| CN | 201568337 | | 9/2010 |
| CN | 101936310 | | 1/2011 |
| CN | 201696365 | U | 1/2011 |
| CN | 201739199 | U | 2/2011 |
| CN | 101984299 | | 3/2011 |
| CN | 101985948 | | 3/2011 |
| CN | 201763705 | | 3/2011 |
| CN | 201763706 | | 3/2011 |
| CN | 201770513 | | 3/2011 |
| CN | 201779080 | | 3/2011 |
| CN | 201802648 | | 4/2011 |
| CN | 102095236 | | 6/2011 |
| CN | 201874901 | U | 6/2011 |
| CN | 201917047 | | 8/2011 |
| CN | 102251973 | A | 11/2011 |
| CN | 102367813 | | 3/2012 |
| DE | 1 291 090 | | 3/1969 |
| DE | 24 51 557 | | 5/1976 |
| DE | 27 48 724 | | 5/1978 |
| DE | 3644567 | | 7/1988 |
| DE | 195 10 397 | | 9/1996 |
| DE | 197 12 228 | | 10/1998 |
| DE | 100 00 400 | | 3/2001 |
| DE | 10041805 | | 6/2002 |
| DE | 10 2009 007 037 | | 8/2010 |
| EP | 0 044 494 | | 1/1982 |
| EP | 0186581 | | 7/1986 |
| EP | 0 784 947 | | 7/1997 |
| EP | 1 094 224 | | 4/2001 |
| EP | 1 138 954 | | 10/2001 |
| EP | 1357296 | B1 | 10/2003 |
| EP | 1 779 745 | | 5/2007 |
| EP | 1 939 456 | | 7/2008 |
| EP | 1 980 432 | | 10/2008 |
| EP | 2 000 675 | | 12/2008 |
| EP | 2191142 | | 6/2010 |
| FR | 1033034 | | 7/1953 |
| FR | 1095114 | | 5/1955 |
| FR | 1119439 | | 6/1956 |
| FR | 1.387.334 | | 1/1965 |
| FR | 2 375 471 | | 7/1978 |
| FR | 2 534 983 | | 4/1984 |
| FR | 2 640 857 | | 6/1990 |
| FR | 2 658 593 | | 8/1991 |
| FR | 2794195 | | 12/2000 |
| FR | 2 874 409 | | 2/2006 |
| FR | 2 906 980 | | 4/2008 |
| FR | 2928706 | | 9/2009 |
| GB | 22235 | | 6/1914 |
| GB | 383498 | | 11/1932 |
| GB | 593828 | | 10/1947 |
| GB | 601222 | | 4/1948 |
| GB | 633273 | | 12/1949 |
| GB | 641622 | | 8/1950 |
| GB | 661747 | | 11/1951 |
| GB | 863 124 | | 3/1961 |
| GB | 1067956 | | 5/1967 |
| GB | 1 262 131 | | 2/1972 |
| GB | 1 265 341 | | 3/1972 |
| GB | 1 278 606 | | 6/1972 |
| GB | 1 304 560 | | 1/1973 |

(56) References Cited

FOREIGN PATENT DOCUMENTS

| | | | |
|---|---|---|---|
| GB | 1 403 188 | | 8/1975 |
| GB | 1 434 226 | | 5/1976 |
| GB | 1 501 473 | | 2/1978 |
| GB | 2 094 400 | | 9/1982 |
| GB | 2 107 787 | | 5/1983 |
| GB | 2 111 125 | | 6/1983 |
| GB | 2 178 256 | | 2/1987 |
| GB | 2 185 531 | | 7/1987 |
| GB | 2 185 533 | | 7/1987 |
| GB | 2 218 196 | | 11/1989 |
| GB | 2 236 804 | | 4/1991 |
| GB | 2 240 268 | | 7/1991 |
| GB | 2 242 935 | | 10/1991 |
| GB | 2 285 504 | | 7/1995 |
| GB | 2 289 087 | | 11/1995 |
| GB | 2383277 | | 6/2003 |
| GB | 2 428 569 | | 2/2007 |
| GB | 2 452 593 | | 3/2009 |
| GB | 2452490 | | 3/2009 |
| GB | 2463698 | | 3/2010 |
| GB | 2464736 | | 4/2010 |
| GB | 2466058 | | 6/2010 |
| GB | 2468312 | | 9/2010 |
| GB | 2468313 | | 9/2010 |
| GB | 2468315 | | 9/2010 |
| GB | 2468317 | A | 9/2010 |
| GB | 2468319 | | 9/2010 |
| GB | 2468320 | | 9/2010 |
| GB | 2468323 | | 9/2010 |
| GB | 2468328 | | 9/2010 |
| GB | 2468331 | | 9/2010 |
| GB | 2468369 | | 9/2010 |
| GB | 2468498 | | 9/2010 |
| GB | 2473037 | | 3/2011 |
| GB | 2479760 | | 10/2011 |
| GB | 2482547 | | 2/2012 |
| GB | 2484695 | A | 4/2012 |
| GB | 2493231 | A | 1/2013 |
| GB | 2493505 | A | 2/2013 |
| GB | 2493507 | A | 2/2013 |
| JP | 31-13055 | | 8/1956 |
| JP | 35-4369 | | 3/1960 |
| JP | 39-7297 | | 3/1964 |
| JP | 49-150403 | | 12/1974 |
| JP | 51-7258 | | 1/1976 |
| JP | 53-60100 | | 5/1978 |
| JP | 56-167897 | | 12/1981 |
| JP | S57-8396 | | 1/1982 |
| JP | 57-71000 | | 5/1982 |
| JP | 57-157097 | | 9/1982 |
| JP | 61-31830 | | 2/1986 |
| JP | 61-116093 | | 6/1986 |
| JP | 61-280787 | | 12/1986 |
| JP | 62-223494 | | 10/1987 |
| JP | 63-179198 | | 7/1988 |
| JP | 63-306340 | | 12/1988 |
| JP | 64-21300 | U | 2/1989 |
| JP | 64-83884 | | 3/1989 |
| JP | 1-138399 | | 5/1989 |
| JP | 1-224598 | | 9/1989 |
| JP | 2-146294 | | 6/1990 |
| JP | 2-218890 | | 8/1990 |
| JP | 2-248690 | | 10/1990 |
| JP | 3-52515 | | 5/1991 |
| JP | 3-123520 | | 5/1991 |
| JP | 3-267598 | | 11/1991 |
| JP | 4-43895 | | 2/1992 |
| JP | 4-366330 | | 12/1992 |
| JP | 5-157093 | | 6/1993 |
| JP | 5-164089 | | 6/1993 |
| JP | 5-263786 | | 10/1993 |
| JP | 6-74190 | | 3/1994 |
| JP | 6-86898 | | 3/1994 |
| JP | 6-147188 | | 5/1994 |
| JP | 6-257591 | | 9/1994 |
| JP | 6-280800 | | 10/1994 |
| JP | 6-336113 | | 12/1994 |
| JP | 7-190443 | | 7/1995 |
| JP | 8-21400 | | 1/1996 |
| JP | 9-100800 | | 4/1997 |
| JP | 9-178083 | | 7/1997 |
| JP | 9-287600 | | 11/1997 |
| JP | 11-227866 | | 8/1999 |
| JP | 2000-116179 | | 4/2000 |
| JP | 2000-201723 | | 7/2000 |
| JP | 2001-17358 | | 1/2001 |
| JP | 2002-21797 | | 1/2002 |
| JP | 2002-138829 | | 5/2002 |
| JP | 2002-213388 | | 7/2002 |
| JP | 2003-329273 | | 11/2003 |
| JP | 2004-8275 | | 1/2004 |
| JP | 2004-208935 | | 7/2004 |
| JP | 2004-216221 | | 8/2004 |
| JP | 2005-201507 | | 7/2005 |
| JP | 2005-307985 | | 11/2005 |
| JP | 2006-89096 | | 4/2006 |
| JP | 3127331 | | 11/2006 |
| JP | 2007-138763 | | 6/2007 |
| JP | 2007-138789 | | 6/2007 |
| JP | 2008-39316 | | 2/2008 |
| JP | 2008-100204 | | 5/2008 |
| JP | 3146538 | | 10/2008 |
| JP | 2008-294243 | | 12/2008 |
| JP | 2009-44568 | | 2/2009 |
| JP | 2009-62986 | | 3/2009 |
| JP | 2010-131259 | | 6/2010 |
| JP | 2010-203764 | | 9/2010 |
| JP | 2012-31806 | | 2/2012 |
| KR | 10-2005-0102317 | | 10/2005 |
| KR | 2007-0007997 | | 1/2007 |
| KR | 20-0448319 | | 3/2010 |
| KR | 10-2010-0055611 | | 5/2010 |
| KR | 10-0985378 | | 9/2010 |
| TW | 517825 | | 1/2003 |
| TW | 589932 | | 6/2004 |
| TW | M394383 | | 12/2010 |
| TW | M399207 | | 3/2011 |
| TW | M407299 | | 7/2011 |
| WO | WO 90/13478 | | 11/1990 |
| WO | WO-95/06822 | | 3/1995 |
| WO | WO-02/073096 | | 9/2002 |
| WO | WO 03/058795 | | 7/2003 |
| WO | WO-03/069931 | | 8/2003 |
| WO | WO-2005/050026 | | 6/2005 |
| WO | WO 2005/057091 | | 6/2005 |
| WO | WO-2006/008021 | | 1/2006 |
| WO | WO-2006/012526 | | 2/2006 |
| WO | WO 2007/024955 | | 3/2007 |
| WO | WO 2007/048205 | | 5/2007 |
| WO | WO 2008/014641 | | 2/2008 |
| WO | WO-2008/024569 | | 2/2008 |
| WO | WO-2008/139491 | | 11/2008 |
| WO | WO-2009/030879 | | 3/2009 |
| WO | WO-2009/030881 | | 3/2009 |
| WO | WO-2010/100449 | A1 | 9/2010 |
| WO | WO-2010/100451 | | 9/2010 |
| WO | WO-2010/100452 | | 9/2010 |
| WO | WO-2010/100453 | | 9/2010 |
| WO | WO-2010/100462 | | 9/2010 |
| WO | WO-2012/006882 | A1 | 1/2012 |
| WO | WO-2012/017219 | | 2/2012 |
| WO | WO-2012/033517 | A1 | 3/2012 |
| WO | WO-2013/014419 | A2 | 1/2013 |

OTHER PUBLICATIONS

Gammack, P. et al., U.S. Office Action mailed Jun. 25, 2012, directed to U.S. Appl. No. 12/716,749; 11 pages.

GB Search Report dated Nov. 22, 2010 directed GB Patent Application No. 1013265.2; 2 pages.

Gammack, P. et al., U.S. Office Action mailed Dec. 9, 2010, directed to U.S. Appl. No. 12/203,698; 10 pages.

Gammack, P et al., U.S. Final Office Action mailed Jun. 21, 2011, directed to U.S. Appl. No. 12/203,698; 11 pages.

(56) References Cited

OTHER PUBLICATIONS

Gammack, P. et al., U.S. Office Action mailed Dec. 10, 2010, directed to U.S. Appl. No. 12/230,613; 12 pages.
Gammack, P. et al., U.S. Office Action mailed May 13, 2011, directed to U.S. Appl. No. 12/230,613; 12 pages.
Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Fitton, et al., U.S. Office Action mailed Mar. 8, 2011, directed to U.S. Appl. No. 12/716,780; 12 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Gammack, P. et al. U.S. Office Action mailed Oct. 18, 2012, directed to U.S. Appl. No. 12/917,247; 11 pages.
Cammack et al., Office Action mailed Jun. 12, 2013, directed towards U.S. Appl. No. 12/945,558; 20 pages.
Gammack et al., Office Action mailed May 29, 2013, directed towards U.S. Appl. No. 13/588,666; 11 pages.
Wallace et al., Office Action mailed Jun. 7, 2013, directed towards U.S. Appl. No. 13/192,223; 30 pages.
Fitton et al., Office Action mailed May 24, 2013, directed towards U.S. Appl. No. 13/481,268; 11 pages.
Gammack et al., Office Action mailed Sep. 17, 2012, directed to U.S. Appl. No. 13/114,707; 12 pages.
Gammack et al., U.S. Office Action mailed Aug. 20, 2012, directed to U.S. Appl. No. 12/945,558; 15 pages.
Gammack, P. et al., U.S. Office Action mailed Sep. 7, 2011, directed to U.S. Appl. No. 12/230,613; 15 pages.
Nicolas, F. et al., U.S. Office Action mailed Sep. 8, 2011, directed to U.S. Appl. No. 12/622,844; 11 pages.
Fitton, et al., U.S. Office Action mailed Sep. 6, 2011, directed to U.S. Appl. No. 12/716,780; 16 pages.
Gammack et al., U.S. Office Action mailed Sep. 6, 2013, directed to U.S. Appl. No. 12/716,740; 15 pages.
Gammack et al., Office Action mailed Sep. 27, 2013, directed to U.S. Appl. No. 13/588,666; 10 pages.
Wallace et al., Office Action mailed Oct. 23, 2013, directed to U.S. Appl. No. 13/192,223; 18 pages.
International Search Report and Written Opinion mailed Oct. 10, 2011, directed to International Patent Application No. PCT/GB2011/051248; 8 pages.
Cammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed May 24, 2011, directed to U.S. Appl. No. 12/716,613; 9 pages.
Helps, D. F. et al., U.S. Office Action mailed Feb. 15, 2013, directed to U.S. Appl. No. 12/716,694; 12 pages.
Fitton et al., U.S. Office Action mailed Mar. 30, 2012, directed to U.S. Appl. No. 12/716,707; 7 pages.
Gammack, P. et al., Office Action mailed Aug. 19, 2013, directed to U.S. Appl. No. 12/716,515; 20 pages.
Gammack et al., U.S. Office Action mailed Feb. 14, 2013, directed to U.S. Appl. No. 12/716,515; 21 pages.
Gammack et al., U.S. Office Action mailed Feb. 28, 2013, directed to U.S. Appl. No. 12/945,558; 16 pages.
Gammack et al., U.S. Office Action mailed Mar. 14, 2013, directed to U.S. Appl. No. 12/716,740; 15 pages.

* cited by examiner

FAN ASSEMBLY

REFERENCE TO RELATED APPLICATIONS

This application claims the priority of United Kingdom Application No. 1013265.2, filed Aug. 6, 2010, the entire contents of which are incorporated herein by reference.

FIELD OF THE INVENTION

The present invention relates to a fan assembly. In a preferred embodiment, the present invention relates to a fan heater for creating a warm air current in a room, office or other domestic environment.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation.

Such fans are available in a variety of sizes and shapes. For example, a ceiling fan can be at least 1 m in diameter, and is usually mounted in a suspended manner from the ceiling to provide a downward flow of air to cool a room. On the other hand, desk fans are often around 30 cm in diameter, and are usually free standing and portable. Floor-standing tower fans generally comprise an elongate, vertically extending casing around 1 m high and housing one or more sets of rotary blades for generating an air flow. An oscillating mechanism may be employed to rotate the outlet from the tower fan so that the air flow is swept over a wide area of a room.

Fan heaters generally comprise a number of heating elements located either behind or in front of the rotary blades to enable a user to heat the air flow generated by the rotating blades. The heating elements are commonly in the form of heat radiating coils or fins. A variable thermostat, or a number of predetermined output power settings, is usually provided to enable a user to control the temperature of the air flow emitted from the fan heater.

A disadvantage of this type of arrangement is that the air flow produced by the rotating blades of the fan heater is generally not uniform. This is due to variations across the blade surface or across the outward facing surface of the fan heater. The extent of these variations can vary from product to product and even from one individual fan heater to another. These variations result in the generation of a turbulent, or 'choppy', air flow which can be felt as a series of pulses of air and which can be uncomfortable for a user. A further disadvantage resulting from the turbulence of the air flow is that the heating effect of the fan heater can diminish rapidly with distance.

In a domestic environment it is desirable for appliances to be as small and compact as possible due to space restrictions. It is undesirable for parts of the appliance to project outwardly, or for a user to be able to touch any moving parts, such as the blades. Fan heaters tend to house the blades and the heat radiating coils within a cage or apertured casing to prevent user injury from contact with either the moving blades or the hot heat radiating coils, but such enclosed parts can be difficult to clean. Consequently, an amount of dust or other detritus can accumulate within the casing and on the heat radiating coils between uses of the fan heater. When the heat radiating coils are activated, the temperature of the outer surfaces of the coils can rise rapidly, particularly when the power output from the coils is relatively high, to a value in excess of 700° C. Consequently, some of the dust which has settled on the coils between uses of the fan heater can be burnt, resulting in the emission of an unpleasant smell from the fan heater for a period of time.

Our co-pending patent application PCT/GB2010/050272 describes a fan heater which does not use caged blades to project air from the fan heater. Instead, the fan heater comprises a base which houses a motor-driven impeller for drawing a primary air flow into the base, and an annular nozzle connected to the base and comprising an annular mouth through which the primary air flow is emitted from the fan. The nozzle defines a central opening through which air in the local environment of the fan assembly is drawn by the primary air flow emitted from the mouth, amplifying the primary air flow to generate an air current. Without the use of a bladed fan to project the air current from the fan heater, a relatively uniform air current can be generated and guided into a room or towards a user. In one embodiment a heater is located within the nozzle to heat the primary air flow before it is emitted from the mouth. By housing the heater within the nozzle, the user is shielded from the hot external surfaces of the heater.

SUMMARY OF THE INVENTION

In a first aspect, the present invention provides a fan assembly comprising means for creating an air flow, means for heating a first portion of the air flow, means for diverting a second portion of the air flow away from the heating means, and a casing comprising at least one first air outlet for emitting the first portion of the air flow and at least one second air outlet from emitting the second portion of the air flow, wherein at least one second air outlet is arranged to direct at least part of the second portion of the air flow over an external surface of the casing.

The present invention thus provides a fan assembly having a plurality of air outlets for emitting air at different temperatures. One or more first air outlets are provided for emitting relatively hot air which has been heated by the heating means, whereas one or more second air outlets are provided for emitting relatively cold air which has by-passed the heating means.

The different air paths thus present within the fan assembly may be selectively opened and closed by a user to vary the temperature of the air flow emitted from the fan assembly. The fan assembly may include a valve, shutter or other means for selectively closing one of the air paths so that all of the air flow leaves the fan assembly through either the first air outlet (s) or the second air outlet(s). For example, a shutter may be slidable or otherwise moveable over the outer surface of the casing to selectively close either the first air outlet(s) or the second air outlet(s), thereby forcing the air flow either to pass through the heating means or to by-pass the heating means. This can enable a user to change rapidly the temperature of the air flow emitted from the casing.

Alternatively, or additionally, the casing may be arranged to emit the first and second portions of the air flow simultaneously.

As mentioned above, at least one second air outlet is arranged to direct at least part of the second portion of the air flow over an external surface of the casing. This can keep that external surface of the casing cool during use of the fan assembly. Where the casing comprises a plurality of second air outlets, the second air outlets may be arranged to direct substantially the entire second portion of the air flow over at least one external surface of the casing. The second air outlets may be arranged to direct the second portion of the air flow over a common external surface of the casing, or over a plurality of external surfaces of the casing, such as front and rear surfaces of the casing.

The, or each, first air outlet is preferably arranged to direct the first portion of the air flow over the second portion of the air flow so that the relatively cold second portion of the air flow is sandwiched between the relatively hot first portion of the air flow and an external surface of the casing, thereby providing a layer of thermal insulation between the relatively hot first portion of the air flow and the external surface of the casing.

The casing is preferably in the form of an annular casing which preferably defines an opening through which air from outside the casing is drawn by the air flow emitted from the air outlets. At least one second air outlet may be arranged to direct the air flow over an external surface of the casing which is remote from the opening. For example, where the casing has an annular shape, one of the second air outlets may be arranged to direct a portion of the air flow over the external surface of an inner annular section of the casing so that that portion of the air flow emitted from that second air outlet passes through the opening, whereas another one of the second air outlets may be arranged to direct another portion of the air flow over the external surface of an outer annular section of the casing. However, all of the first and second air outlets are preferably arranged to emit the air flow through the opening in order to maximize the amplification of the air flow emitted from the casing through the entrainment of air external to the casing.

In a second aspect the present invention provides a fan assembly comprising means for creating an air flow, means for heating a first portion of the air flow, means for diverting a second portion of the air flow away from the heating means, and a casing comprising a plurality of air outlets for emitting the air flow from the casing, the casing having an annular external surface defining an opening through which air from outside the casing is drawn by the air flow emitted from the air outlets, wherein the plurality of air outlets comprises at least one first air outlet for emitting the first portion of the air flow through the opening and at least one second air outlet from emitting the second portion of the air flow through the opening, wherein said at least one second air outlet is arranged to direct the second portion of the air flow over said external surface of the casing, and said at least one first air outlet is arranged to direct the first portion of the air flow over the second portion of the air flow.

In addition to directing the air flow emitted from the second air outlet(s) over an external surface of the casing, the casing may be arranged to convey the second portion of the air flow over or along at least one of the internal surfaces of the casing to keep that surface relatively cool during the use of the fan assembly. Alternatively, the diverting means may be arranged to divert both a second portion and a third portion of the air flow away from the heating means, and the interior passage may be arranged to convey the second portion of the air flow along a first internal surface of the casing, for example the internal surface of an inner annular section of the casing, and to convey the third portion of the air flow along a second internal surface of the casing, for example the internal surface of an outer annular section of the casing.

In this case, it may be found that, depending on the temperature of the first portion of the air flow, sufficient cooling of the external surfaces of the casing may be provided without having to emit both the second and the third portions of the air flow separately from the first portion of the air flow. For example, the first and the third portions of the air flow may be recombined downstream from the heating means, whereas the second portion of the air flow may be directed over the external surface of the inner annular casing.

The diverting means may comprise at least one baffle, wall or other surface for diverting the second portion of the air flow away from the heating means. The diverting means may be integral with or connected to one of the casing sections. The diverting means may conveniently form part of, or be connected to, a chassis for retaining the heating means. Where the diverting means is arranged to divert both a second portion of the air flow and a third portion of the air flow away from the heating means, the diverting means may comprise two mutually spaced parts of the chassis.

Preferably, the casing comprises first channel means for conveying the first portion of the air flow to the first air outlet(s), second channel means for conveying the second portion of the air flow to the second air outlet(s), and means for separating the first channel means from the second channel means. The separating means may be integral with the diverting means for diverting the second portion of the air flow away from the heating means, and thus may comprise at least one side wall of a chassis for retaining the heating means. This can reduce the number of separate components of the fan assembly. The casing may also comprise third channel means for conveying a third portion of the air flow away from the heating means, and preferably along an internal surface of the casing. The second channel means may also be arranged to convey the second portion of the air flow along an internal surface of the casing.

The chassis may comprise first and second side walls configured to retain a heating assembly therebetween. The first and second side walls may form a first channel therebetween, which includes the heating means, for conveying the first portion of the air flow to a first air outlet of the casing. The first side wall and a first internal surface of the casing may form a second channel for conveying the second portion of the air flow along the first internal surface to a second air outlet of the casing. The second side wall and a second internal surface of the casing may optionally form a third channel for conveying a third portion of the air flow along the second internal surface. This third channel may merge with the first or second channel, or it may convey the third portion of the air flow to an air outlet of the casing.

As mentioned above, the casing may comprise an inner annular casing section and an outer annular casing section which define an interior passage therebetween for receiving the air flow, and the separating means may be located between the casing sections. Each casing section is preferably formed from a respective annular member, but each casing section may be provided by a plurality of members connected together or otherwise assembled to form that casing section. The inner casing section and the outer casing section may be formed from plastics material or other material having a relatively low thermal conductivity (less than 1 $Wm^{-1}K^{-1}$), to prevent the external surfaces of the casing from becoming excessively hot during use of the fan assembly.

The separating means may also define in part the first air outlet(s) and/or the second air outlet(s) of the casing. For example, the first air outlet(s) may be located between an internal surface of the outer casing section and the separating means. Alternatively, or additionally, the at least one second air outlet may be located between an external surface of the inner casing section and the separating means. Where the separating means comprises a wall for separating a first channel from a second channel, a first air outlet may be located between the internal surface of the outer casing section and a first side surface of the wall, and a second air outlet may be located between the external surface of the inner casing section and a second side surface of the wall.

The separating means may comprise a plurality of spacers for engaging at least one of the inner casing section and the outer casing section. This can enable the width of at least one of the second channel means and the third channel means to be controlled along the length thereof through engagement between the spacers and said at least one of the inner casing section and the outer casing section.

The direction in which air is emitted from the air outlets is preferably substantially at a right angle to the direction in which the air flow passes through at least part of the interior passage. Preferably, the air flow passes through at least part of the interior passage in a substantially vertical direction, and the air is emitted from the air outlets in a substantially horizontal direction. The interior passage is preferably located towards the front of the casing, whereas the air outlets are preferably located towards the rear of the casing and arranged to direct air towards the front of the casing and through the opening. Consequently, each of the first and second channel means may be shaped so as substantially to reverse the flow direction of a respective portion of the air flow.

The interior passage is preferably annular, and is preferably shaped to divide the air flow into two air streams which flow in opposite directions around the opening. In this case the heating means is preferably arranged to heat a first portion of each air stream and the diverting means is arranged to divert a second portion of each air stream away from the heating means. These first portions of the air streams may be emitted from a common first air outlet of the casing. For example, a single first air outlet may extend about the opening of the casing. Alternatively, each first portion of the air stream may be emitted from a respective first air outlet of the casing, and together form the first portion of the air flow. These first air outlets may be located on opposite sides of the opening.

Similarly, the second portions of the two air streams may be emitted from a common second air outlet of the casing. Again, this single second air outlet may extend about the opening of the casing. Alternatively, the second portion of each air stream may be emitted from a respective second air outlet of the casing, and together form the second portion of the air flow. Again, these second air outlets may be located on opposite sides of the opening.

At least part of the heating means may be arranged within the casing. The heating means may extend about the opening. Where the casing defines a circular opening, the heating means preferably extends at least 270° about the opening and more preferably at least 300° about the opening. Where the casing defines an elongate opening, that is, an opening having a height greater than its width, the heating means is preferably located on at least the opposite sides of the opening.

The heating means may comprise at least one ceramic heater located within the interior passage. The ceramic heater may be porous so that the first portion of the air flow passes through pores in the heating means before being emitted from the first air outlet(s). The heater may be formed from a PTC (positive temperature coefficient) ceramic material which is capable of rapidly heating the air flow upon activation.

The ceramic material may be at least partially coated in metallic or other electrically conductive material to facilitate connection of the heating means to a controller within the fan assembly for activating the heating means. Alternatively, at least one non-porous, preferably ceramic, heater may be mounted within a metallic frame located within the interior passage and which is connectable to a controller of the fan assembly. The metallic frame preferably comprises a plurality of fins to provide a greater surface area and hence better heat transfer to the air flow, while also providing a means of electrical connection to the heating means.

The heating means preferably comprises at least one heater assembly. Where the air flow is divided into two air streams, the heating means preferably comprises a plurality of heater assemblies each for heating a first portion of a respective air stream, and the diverting means preferably comprises a plurality of walls each for diverting a second portion of a respective air stream away from a heater assembly.

Each air outlet is preferably in the form of a slot, and which preferably has a width in the range from 0.5 to 5 mm. The width of the first air outlet(s) is preferably different from that of the second air outlet(s). In a preferred embodiment, the width of the first air outlet(s) is greater than the width of the second air outlet(s) so that the majority of the primary air flow passes through the heating means.

The external surface of the casing over which the air outlets are arranged to direct the air flow emitted therefrom is preferably a curved surface, and more preferably is a Coanda surface. Preferably, the external surface of the inner casing section of the casing is shaped to define the Coanda surface. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1966 pages 84 to 92. Through use of a Coanda surface, an increased amount of air from outside the fan assembly is drawn through the opening by the air emitted from the air outlets.

In a preferred embodiment an air flow is created through the casing of the fan assembly. In the following description this air flow will be referred to as the primary air flow. The primary air flow is emitted from the air outlets of the casing and preferably passes over a Coanda surface. The primary air flow entrains air surrounding the casing, which acts as an air amplifier to supply both the primary air flow and the entrained air to the user. The entrained air will be referred to here as a secondary air flow. The secondary air flow is drawn from the room space, region or external environment surrounding the mouth of the casing and, by displacement, from other regions around the fan assembly, and passes predominantly through the opening defined by the casing. The primary air flow directed over the Coanda surface combined with the entrained secondary air flow equates to a total air flow emitted or projected forward from the opening defined by the casing.

Preferably, the casing comprises a diffuser surface located downstream of the Coanda surface. The diffuser surface directs the air flow emitted towards a user's location while maintaining a smooth, even output. Preferably, the external surface of the inner casing section of the casing is shaped to define the diffuser surface. The external surface preferably comprises a guide portion located downstream from the diffuser surface, the guide portion being inclined inwardly relative to the diffuser surface. The guide portion may be cylindrical, or it may taper inwardly or outwardly relative to an axis about which the external surface extends. An outwardly tapering surface may be provided downstream from this guide portion.

The fan assembly preferably also comprises a base housing said means for creating the air flow, with the casing being connected to the base. The base is preferably generally cylindrical in shape, and comprises a plurality of air inlets through which the air flow enters the fan assembly.

The means for creating an air flow through the casing preferably comprises an impeller driven by a motor. This can provide a fan assembly with efficient air flow generation. The means for creating an air flow preferably comprises a DC brushless motor. This can avoid frictional losses and carbon debris from the brushes used in a traditional brushed motor. Reducing carbon debris and emissions is advantageous in a clean or pollutant sensitive environment such as a hospital or around those with allergies. While induction motors, which are generally used in bladed fans, also have no brushes, a DC brushless motor can provide a much wider range of operating speeds than an induction motor.

The heating means is preferably located in the casing. The diverting means may also be located in the casing. However, the heating means need not be located within the casing. For example, both the heating means and the diverting means may be located in the base, with the casing being arranged to receive a relatively hot first portion of the air flow and a relatively cold second portion of the air flow from the base, and to convey the first portion of the air flow to the first air outlet(s) and the second portion of the air flow to the second air outlet(s). The casing may comprise internal walls or baffles for defining the first channel means and second channel means.

Alternatively, the heating means may be located in the casing but the diverting means may be located in the base. In this case, the first channel means may be arranged both to convey the first portion of the air flow from the base to the at least one first air outlet and to house the heating means for heating the first portion of the air flow, while the second channel means may be arranged simply to convey the second portion of the air flow from the base to the at least one second air outlet.

The fan assembly is preferably in the form of a portable fan heater.

Features described above in connection with the first aspect of the invention are equally applicable to the second aspect of the invention, and vice versa.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
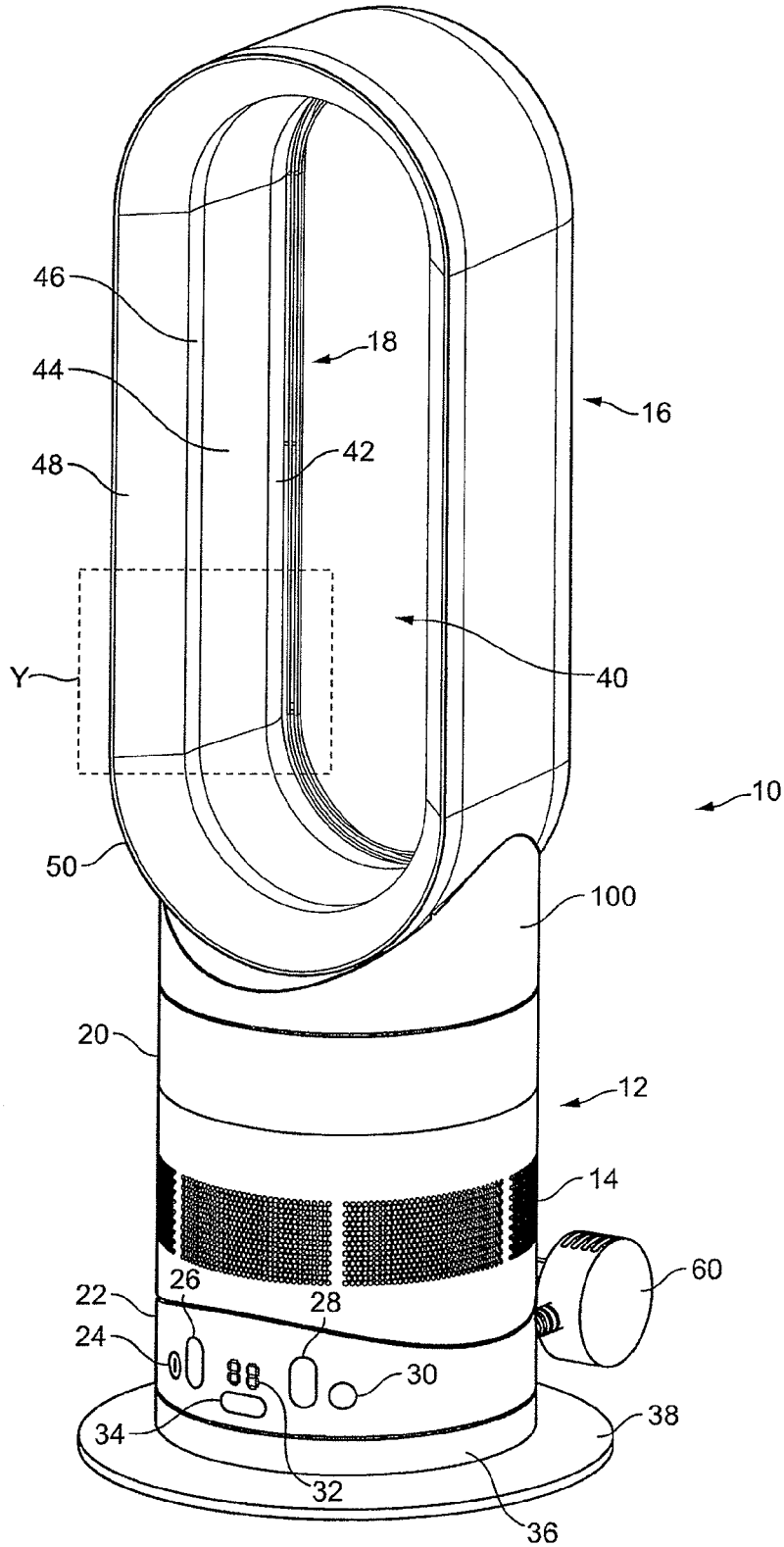
FIG. 1 is a front perspective view, from above, of a fan assembly.
Figure 2:
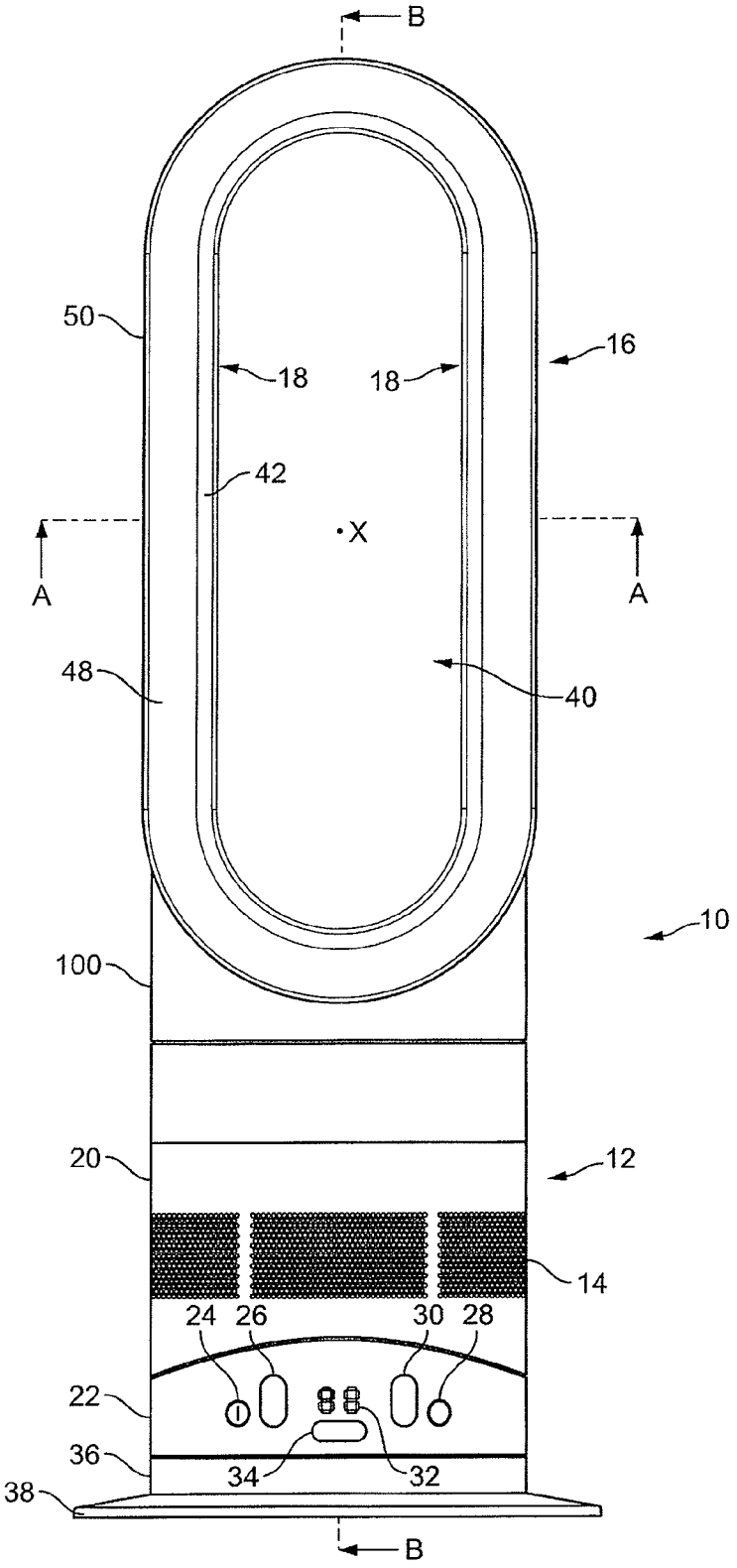
FIG. 2 is a front view of the fan assembly.

FIGS. 1 and 2 illustrate external views of a fan assembly 10. The fan assembly 10 is in the form of a portable fan heater. The fan assembly 10 comprises a body 12 comprising an air inlet 14 through which a primary air flow enters the fan assembly 10, and a nozzle 16 in the form of an annular casing mounted on the body 12, and which comprises at least one air outlet 18 for emitting the primary air flow from the fan assembly 10.

The body 12 comprises a substantially cylindrical main body section 20 mounted on a substantially cylindrical lower body section 22. The main body section 20 and the lower body section 22 preferably have substantially the same external diameter so that the external surface of the upper body section 20 is substantially flush with the external surface of the lower body section 22. In this embodiment the body 12 has a height in the range from 100 to 300 mm, and a diameter in the range from 100 to 200 mm.

The main body section 20 comprises the air inlet 14 through which the primary air flow enters the fan assembly 10. In this embodiment the air inlet 14 comprises an array of apertures formed in the main body section 20. Alternatively, the air inlet 14 may comprise one or more grilles or meshes mounted within windows formed in the main body section 20. The main body section 20 is open at the upper end (as illustrated) thereof to provide an air outlet 23 through which the primary air flow is exhausted from the body 12.

The main body section 20 may be tilted relative to the lower body section 22 to adjust the direction in which the primary air flow is emitted from the fan assembly 10. For example, the upper surface of the lower body section 22 and the lower surface of the main body section 20 may be provided with interconnecting features which allow the main body section 20 to move relative to the lower body section 22 while preventing the main body section 20 from being lifted from the lower body section 22. For example, the lower body section 22 and the main body section 20 may comprise interlocking L-shaped members.

Figure 12:
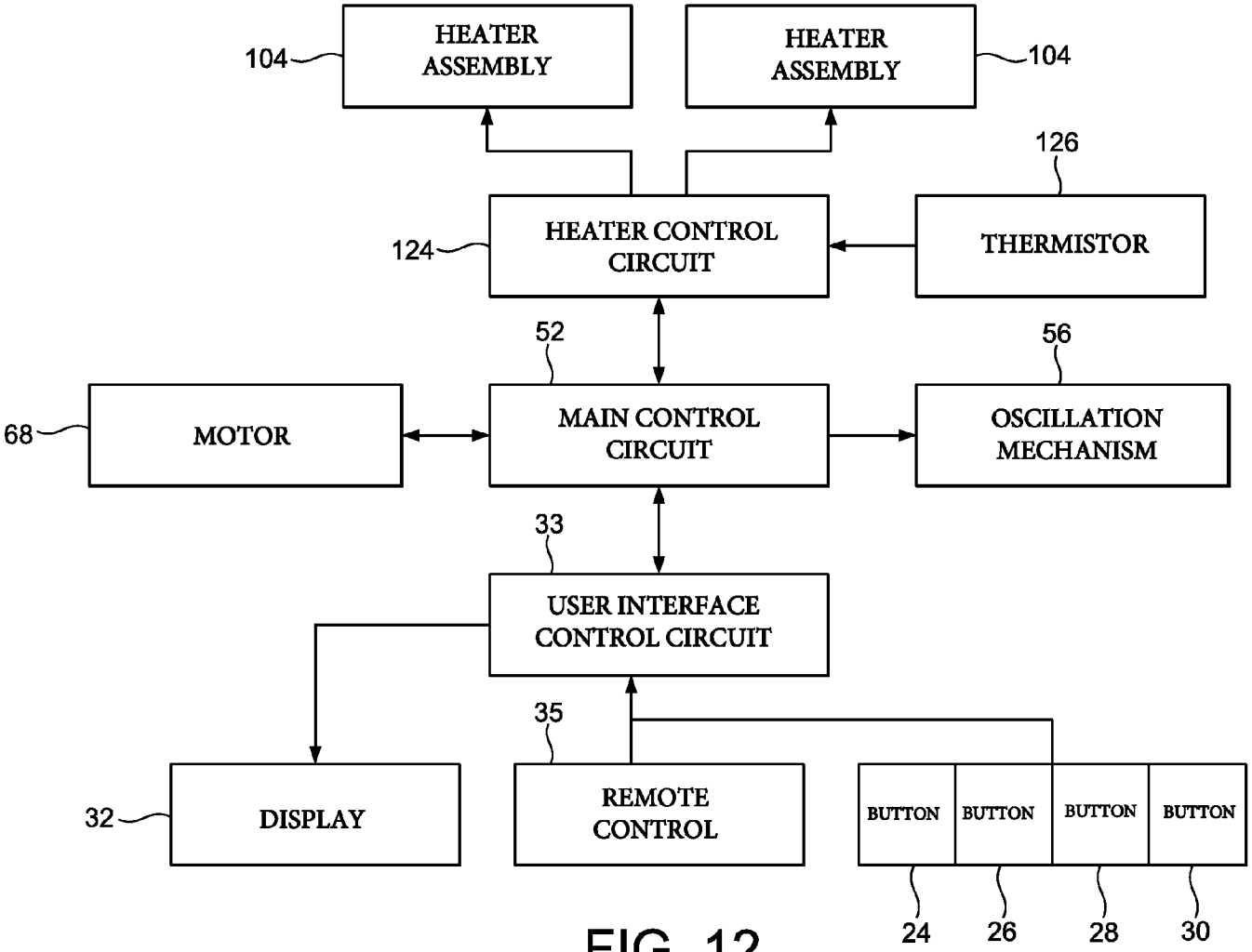
FIG. 12 is a schematic illustration of a control system of the fan assembly.

The lower body section 22 comprises a user interface of the fan assembly 10. With reference also to FIG. 12, the user interface comprises a plurality of user-operable buttons 24, 26, 28, 30 for enabling a user to control various functions of the fan assembly 10, a display 32 located between the buttons for providing the user with, for example, a visual indication of a temperature setting of the fan assembly 10, and a user interface control circuit 33 connected to the buttons 24, 26, 28, 30 and the display 32. The lower body section 22 also includes a window 34 through which signals from a remote control 35 (shown schematically in FIG. 12) enter the fan assembly 10. The lower body section 22 is mounted on a base 36 for engaging a surface on which the fan assembly 10 is located. The base 36 includes an optional base plate 38, which preferably has a diameter in the range from 200 to 300 mm.

The nozzle 16 has an annular shape, extending about a central axis X to define an opening 40. The air outlets 18 for emitting the primary air flow from the fan assembly 10 are located towards the rear of the nozzle 16, and arranged to direct the primary air flow towards the front of the nozzle 16, through the opening 40. In this example, the nozzle 16 defines an elongate opening 40 having a height greater than its width, and the air outlets 18 are located on the opposite elongate sides of the opening 40. In this example the maximum height of the opening 40 is in the range from 300 to 400 mm, whereas the maximum width of the opening 40 is in the range from 100 to 200 mm.

The inner annular periphery of the nozzle 16 comprises a Coanda surface 42 located adjacent the air outlets 18, and over which at least some of the air outlets 18 are arranged to direct the air emitted from the fan assembly 10, a diffuser surface 44 located downstream of the Coanda surface 42 and a guide surface 46 located downstream of the diffuser surface 44. The diffuser surface 44 is arranged to taper away from the central axis X of the opening 40. The angle subtended between the diffuser surface 44 and the central axis X of the opening 40 is in the range from 5 to 25°, and in this example is around 7°. The guide surface 46 is preferably arranged substantially parallel to the central axis X of the opening 40 to present a substantially flat and substantially smooth face to the air flow emitted from the opening 40. A visually appealing tapered surface 48 is located downstream from the guide surface 46, terminating at a tip surface 50 lying substantially perpendicular to the central axis X of the opening 40. The angle subtended between the tapered surface 48 and the central axis X of the opening 40 is preferably around 45°.

Figure 3:
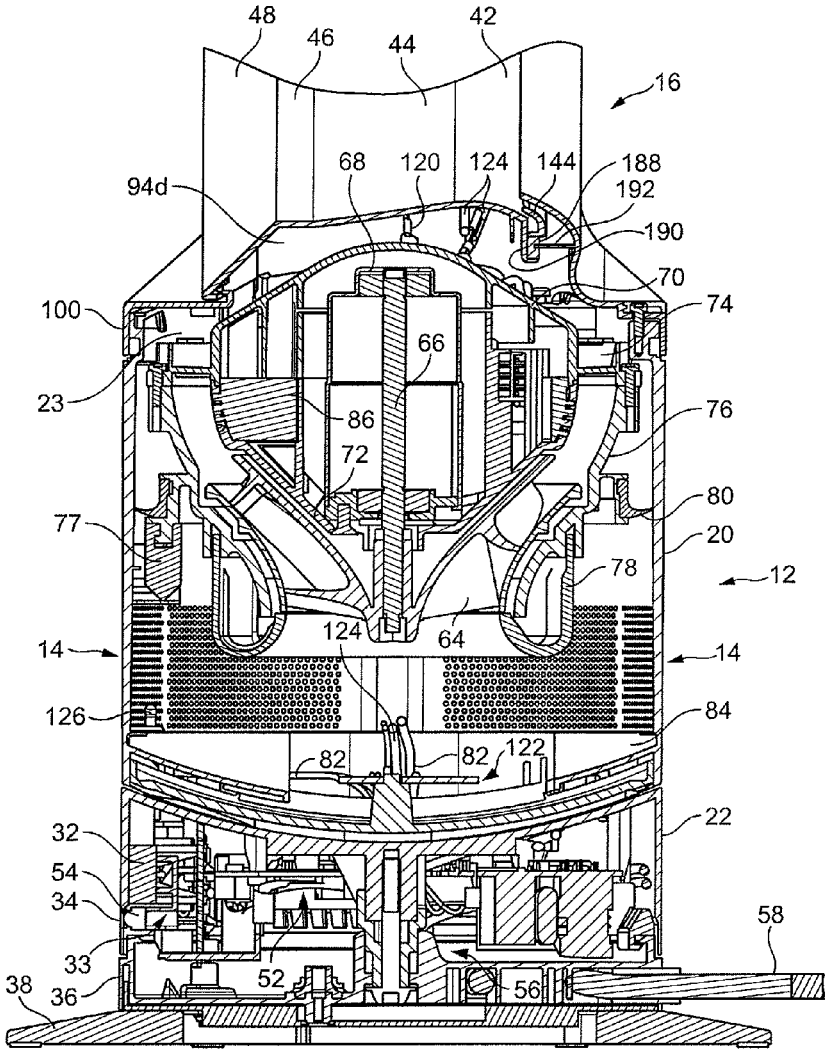
FIG. 3 is a sectional view taken along line B-B of FIG. 2.

FIG. 3 illustrates a sectional view through the body 12. The lower body section 22 houses a main control circuit, indicated generally at 52, connected to the user interface control circuit 33. The user interface control circuit 33 comprises a sensor 54 for receiving signals from the remote control 35. The sensor 54 is located behind the window 34. In response to operation of the buttons 24, 26, 28, 30 and the remote control 35, the user interface control circuit 33 is arranged to transmit appropriate signals to the main control circuit 52 to control various operations of the fan assembly 10. The display 32 is located within the lower body section 22, and is arranged to illuminate part of the lower body section 22. The lower body section 22 is preferably formed from a translucent plastics material which allows the display 32 to be seen by a user.

The lower body section 22 also houses a mechanism, indicated generally at 56, for oscillating the lower body section 22 relative to the base 36. The operation of the oscillating mechanism 56 is controlled by the main control circuit 52 upon receipt of an appropriate control signal from the remote control 35. The range of each oscillation cycle of the lower body section 22 relative to the base 36 is preferably between 60° and 120°, and in this embodiment is around 80°. In this embodiment, the oscillating mechanism 56 is arranged to perform around 3 to 5 oscillation cycles per minute. A mains power cable 58 for supplying electrical power to the fan assembly 10 extends through an aperture formed in the base 36. The cable 58 is connected to a plug 60.

The main body section 20 houses an impeller 64 for drawing the primary air flow through the air inlet 14 and into the body 12. Preferably, the impeller 64 is in the form of a mixed flow impeller. The impeller 64 is connected to a rotary shaft 66 extending outwardly from a motor 68. In this embodiment, the motor 68 is a DC brushless motor having a speed which is variable by the main control circuit 52 in response to user manipulation of the button 26 and/or a signal received from the remote control 35. The maximum speed of the motor 68 is preferably in the range from 5,000 to 10,000 rpm. The motor 68 is housed within a motor bucket comprising an upper portion 70 connected to a lower portion 72. The upper portion 70 of the motor bucket comprises a diffuser 74 in the form of a stationary disc having spiral blades.

The motor bucket is located within, and mounted on, a generally frusto-conical impeller housing 76. The impeller housing 76 is, in turn, mounted on a plurality of angularly spaced supports 77, in this example three supports, located within and connected to the main body section 20 of the base 12. The impeller 64 and the impeller housing 76 are shaped so that the impeller 64 is in close proximity to, but does not contact, the inner surface of the impeller housing 76. A substantially annular inlet member 78 is connected to the bottom of the impeller housing 76 for guiding the primary air flow into the impeller housing 76.

A flexible sealing member 80 is mounted on the impeller housing 76. The flexible sealing member prevents air from passing around the outer surface of the impeller housing to the inlet member 78. The sealing member 80 preferably comprises an annular lip seal, preferably formed from rubber. The sealing member 80 further comprises a guide portion in the form of a grommet for guiding an electrical cable 82 to the motor 68. The electrical cable 82 passes from the main control circuit 52 to the motor 68 through apertures formed in the main body section 20 and the lower body section 22 of the body 12, and in the impeller housing 76 and the motor bucket.

Preferably, the body 12 includes silencing foam for reducing noise emissions from the body 12. In this embodiment, the main body section 20 of the body 12 comprises a first annular foam member 84 located beneath the air inlet 14, and a second annular foam member 86 located within the motor bucket.

Figure 4:
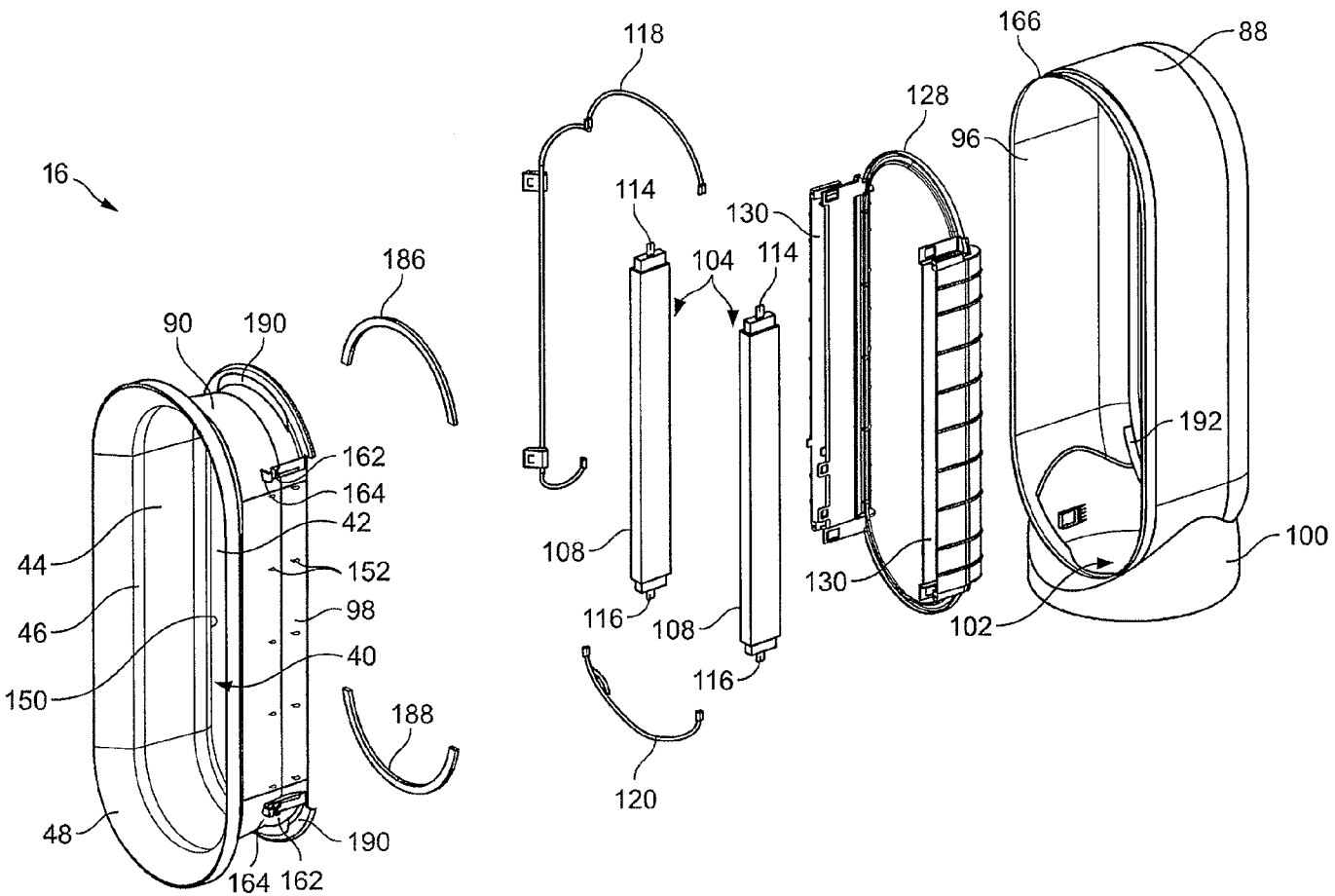
FIG. 4 is an exploded view of the nozzle of the fan assembly.

The nozzle 16 will now be described in more detail with reference to FIGS. 4 to 11. With reference first to FIG. 4, the nozzle 16 comprises an annular outer casing section 88 connected to and extending about an annular inner casing section 90. Each of these sections may be formed from a plurality of connected parts, but in this embodiment each of the casing sections 88, 90 is formed from a respective, single molded part. The inner casing section 90 defines the central opening 40 of the nozzle 16, and has an external surface 92 which is shaped to define the Coanda surface 42, diffuser surface 44, guide surface 46 and tapered surface 48.

Figure 9:
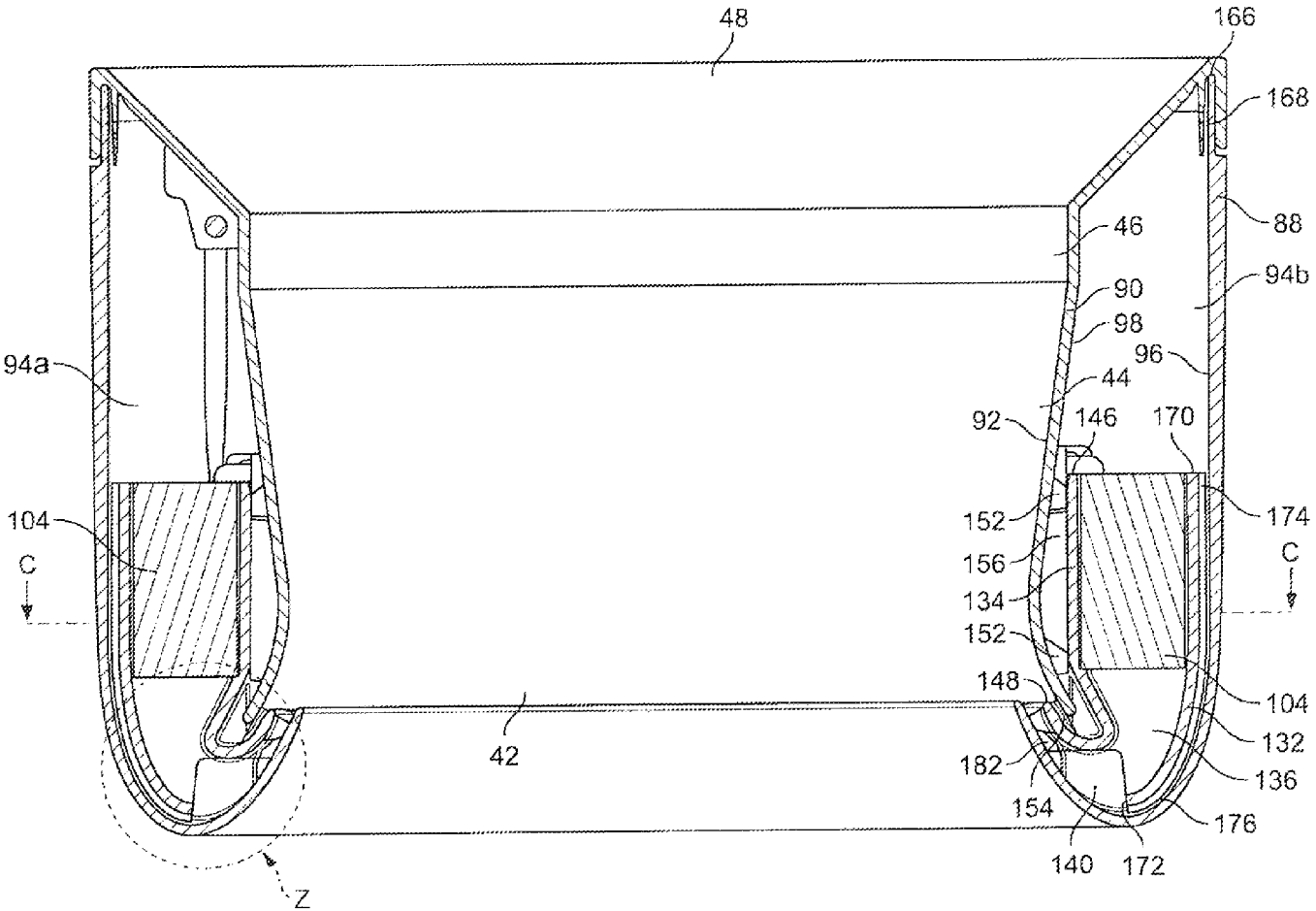
FIG. 9 is a sectional view taken along line A-A of FIG. 2.
Figure 10:
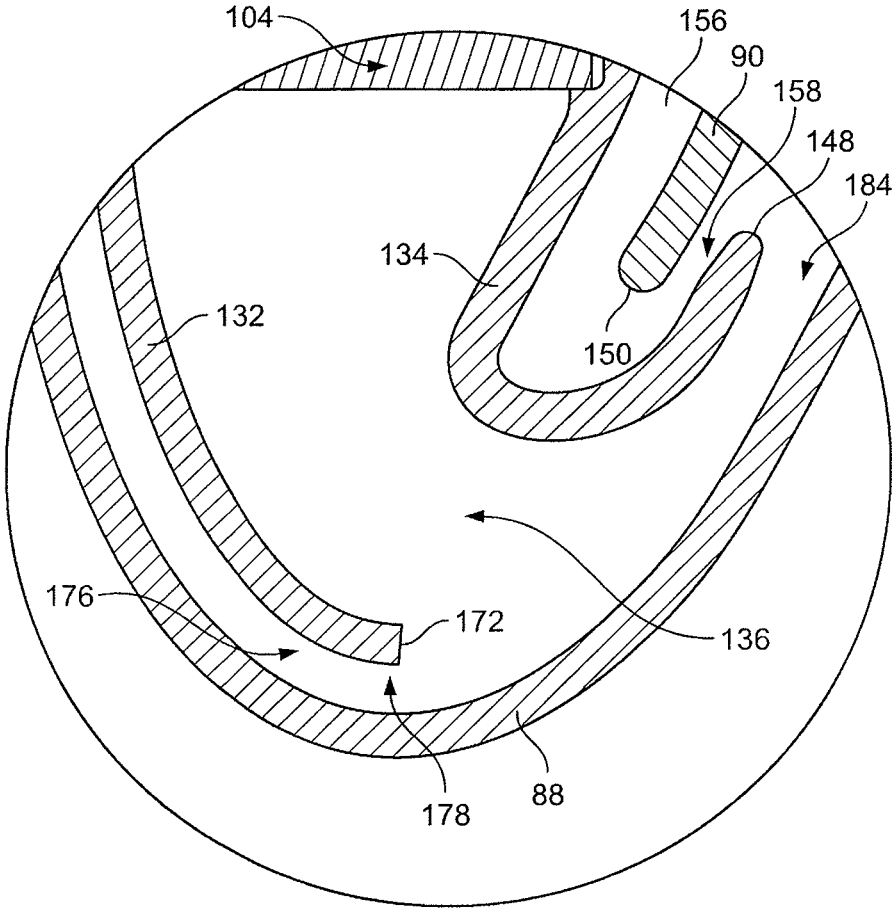
FIG. 10 is a close-up view of region Z indicated in FIG. 9.
Figure 11:
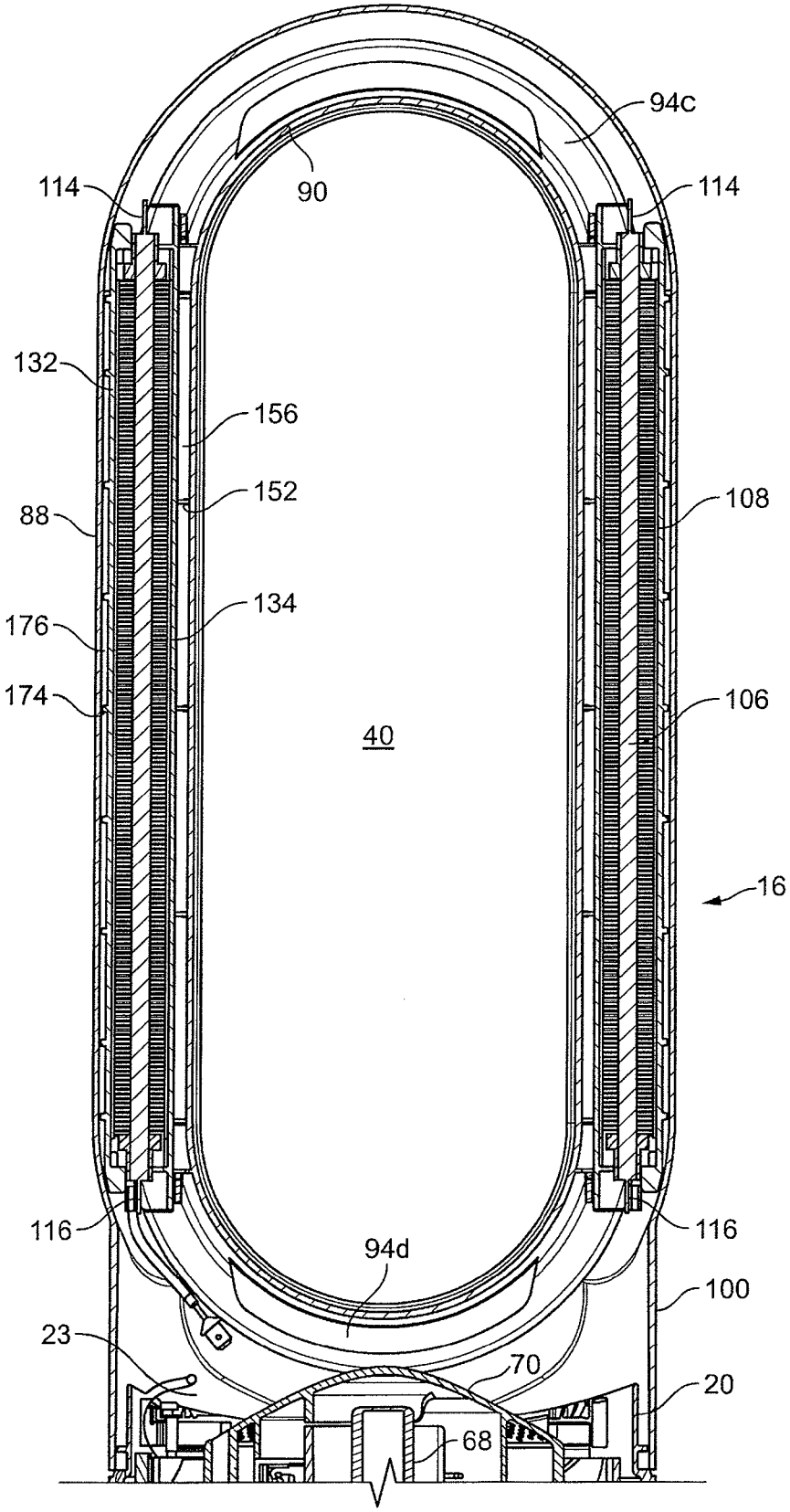
FIG. 11 is a sectional view of the nozzle taken along line C-C of FIG. 9.

The outer casing section 88 and the inner casing section 90 together define an annular interior passage of the nozzle 16. As illustrated in FIGS. 9 and 11, the interior passage extends about the opening 40, and thus comprises two relatively straight sections 94*a*, 94*b* each adjacent a respective elongate side of the opening 40, an upper curved section 94*c* joining the upper ends of the straight sections 94*a*, 94*b*, and a lower curved section 94*d* joining the lower ends of the straight 94*a*, 94*b*. The interior passage is bounded by the internal surface 96 of the outer casing section 88 and the internal surface 98 of the inner casing section 90.

As also shown in FIGS. 1 to 3, the outer casing section 88 comprises a base 100 which is connected to, and over, the open upper end of the main body section 20 of the base 12. The base 100 of the outer casing section 88 comprises an air inlet 102 through which the primary air flow enters the lower curved section 94*d* of the interior passage from the air outlet 23 of the base 12. Within the lower curved section 94*d*, the primary air flow is divided into two air streams which each flow into a respective one of the straight sections 94*a*, 94*b* of the interior passage.

The nozzle 16 also comprises a pair of heater assemblies 104. Each heater assembly 104 comprises a row of heater elements 106 arranged side-by-side. The heater elements 106 are preferably formed from positive temperature coefficient (PTC) ceramic material. The row of heater elements is sandwiched between two heat radiating components 108, each of which comprises an array of heat radiating fins located within a frame. The heat radiating components 108 are preferably formed from aluminium or other material with high thermal conductivity (around 200 to 400 W/mK), and may be attached to the row of heater elements 106 using beads of silicone adhesive, or by a clamping mechanism. The side surfaces of the heater elements 106 are preferably at least partially covered with a metallic film to provide an electrical contact between the heater elements 106 and the heat radiating components 108. This film may be formed from screen printed or sputtered aluminium. Returning to FIGS. 3 and 4, electrical terminals 114, 116 located at opposite ends of the heater assembly 104 are each connected to a respective heat radiating component 108. Each terminal 114 is connected to an upper part 118 of a loom for supplying electrical power to the heater assemblies 104, whereas each terminal 116 is connected to a lower part 120 of the loom. The loom is in turn connected to a heater control circuit 122 located in the main body section 20 of the base 12 by wires 124. The heater control circuit 122 is in turn controlled by control signals supplied thereto by the main control circuit 52 in response to user operation of the buttons 28, 30 and/or use of the remote control 35.

FIG. 12 illustrates schematically a control system of the fan assembly 10, which includes the control circuits 33, 52, 122, buttons 24, 26, 28, 30, and remote control 35. Two or more of the control circuits 33, 52, 122 may be combined to form a single control circuit. A thermistor 126 for providing an indication of the temperature of the primary air flow entering the fan assembly 10 is connected to the heater controller 122. The thermistor 126 may be located immediately behind the air inlet 14, as shown in FIG. 3. The main control circuit 52 supplies control signals to the user interface control circuit 33, the oscillation mechanism 56, the motor 68, and the heater control circuit 124, whereas the heater control circuit 124 supplies control signals to the heater assemblies 104. The heater control circuit 124 may also provide the main control circuit 52 with a signal indicating the temperature detected by the thermistor 126, in response to which the main control circuit 52 may output a control signal to the user interface control circuit 33 indicating that the display 32 is to be changed, for example if the temperature of the primary air flow is at or above a user selected temperature. The heater assemblies 104 may be controlled simultaneously by a common control signal, or they may be controlled by respective control signals.

The heater assemblies 104 are each retained within a respective straight section 94*a*, 94*b* of the interior passage by a chassis 128. The chassis 128 is illustrated in more detail in FIG. 5. The chassis 128 has a generally annular structure. The chassis 128 comprises a pair of heater housings 130 into which the heater assemblies 104 are inserted. Each heater housing 130 comprises an outer wall 132 and an inner wall 134. The inner wall 134 is connected to the outer wall 132 at the upper and lower ends 138, 140 of the heater housing 130 so that the heater housing 130 is open at the front and rear ends thereof. The walls 132, 134 thus define a first air flow channel 136 which passes through the heater assembly 104 located within the heater housing 130.

The heater housings 130 are connected together by upper and lower curved portions 142, 144 of the chassis 128. Each curved portion 142, 144 also has an inwardly curved, generally U-shaped cross-section. The curved portions 142, 144 of the chassis 128 are connected to, and preferably integral with, the inner walls 134 of the heater housings 130. The inner walls 134 of the heater housings 130 have a front end 146 and a rear end 148. With reference also to FIGS. 6 to 9, the rear end 148 of each inner wall 134 also curves inwardly away from the adjacent outer wall 132 so that the rear ends 148 of the inner walls 134 are substantially continuous with the curved portions 142, 144 of the chassis 128.

During assembly of the nozzle 16, the chassis 128 is pushed over the rear end of the inner casing section 90 so that the curved portions 142, 144 of the chassis 128 and the rear ends 148 of the inner walls 134 of the heater housings 130 are wrapped around the rear end 150 of the inner casing section 90. The inner surface 98 of the inner casing section 90 comprises a first set of raised spacers 152 which engage the inner walls 134 of the heater housings 130 to space the inner walls 134 from the inner surface 98 of the inner casing section 90. The rear ends 148 of the inner walls 134 also comprise a second set of spacers 154 which engage the outer surface 92 of the inner casing section 90 to space the rear ends of the inner walls 134 from the outer surface 92 of the inner casing section 90.

The inner walls 134 of the heater housing 130 of the chassis 128 and the inner casing section 90 thus define two second air flow channels 156. Each of the second flow channels 156 extends along the inner surface 98 of the inner casing section 90, and around the rear end 150 of the inner casing section 90. Each second flow channel 156 is separated from a respective first flow channel 136 by the inner wall 134 of the heater housing 130. Each second flow channel 156 terminates at an air outlet 158 located between the outer surface 92 of the inner casing section 90 and the rear end 148 of the inner wall 134. Each air outlet 158 is thus in the form of a vertically-extending slot located on a respective side of the opening 40 of the assembled nozzle 16. Each air outlet 158 preferably has a width in the range from 0.5 to 5 mm, and in this example the air outlets 158 have a width of around 1 mm.

Figure 5:
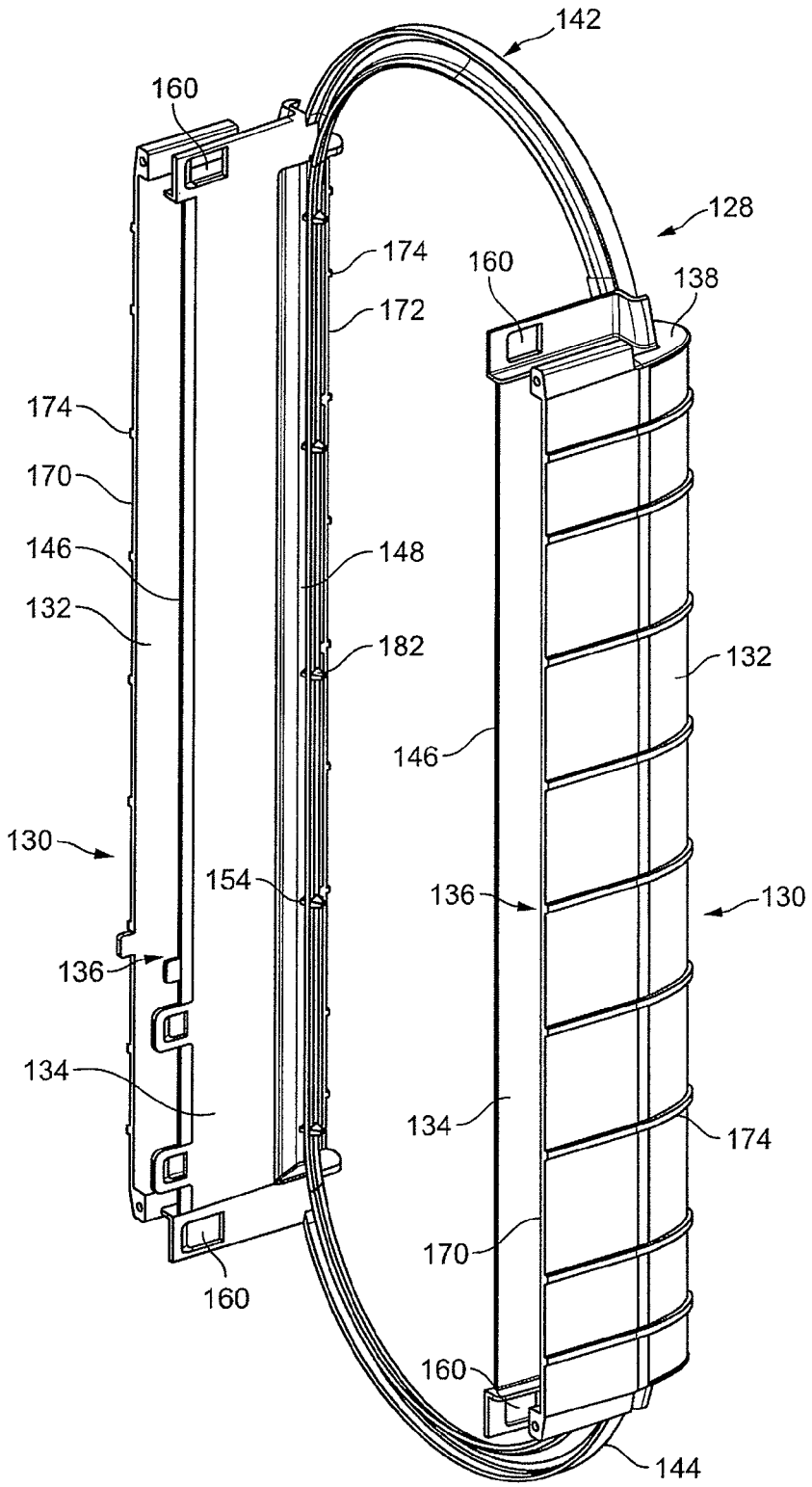
FIG. 5 is a front perspective view of the heater chassis of the nozzle.
Figure 6:
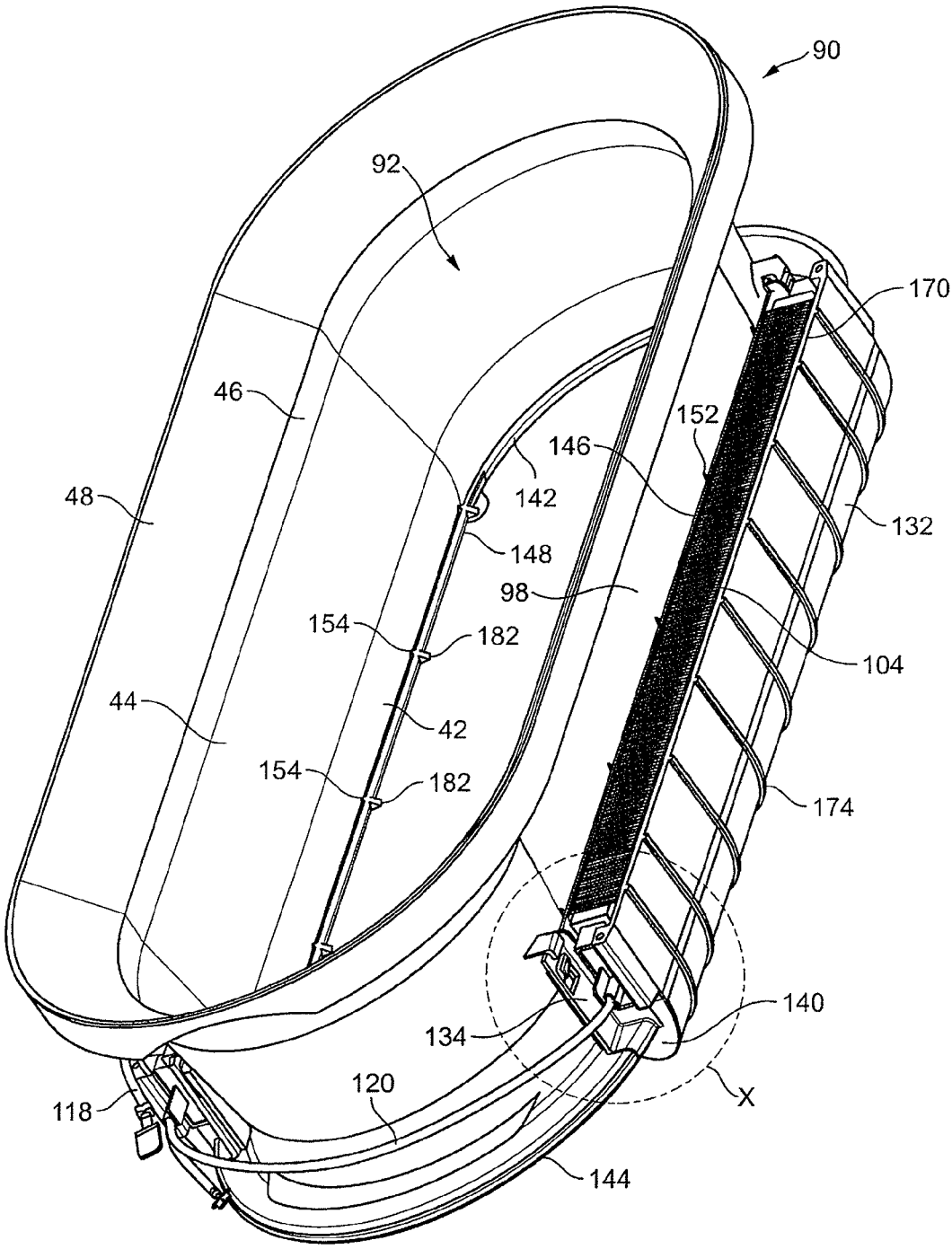
FIG. 6 is a front perspective view, from below, of the heater chassis connected to an inner casing section of the nozzle.
Figure 7:
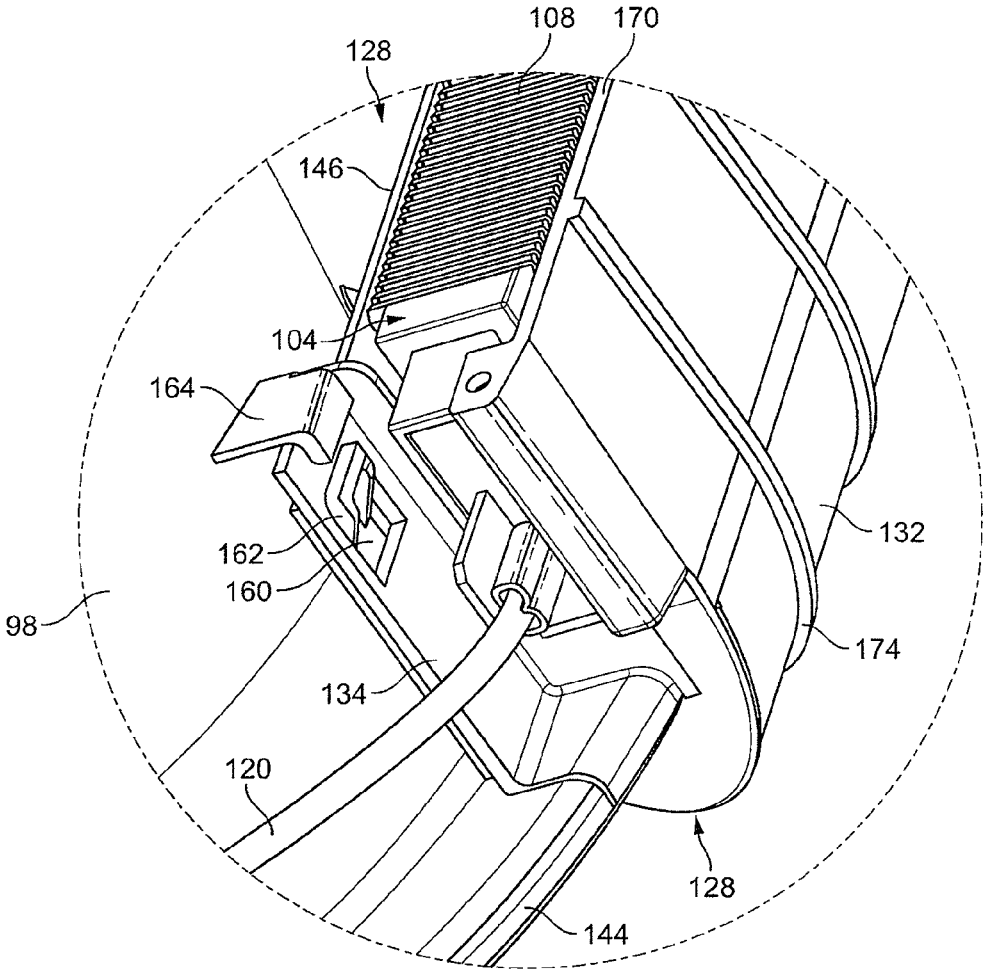
FIG. 7 is a close-up view of region X indicated in FIG. 6.
Figure 8:
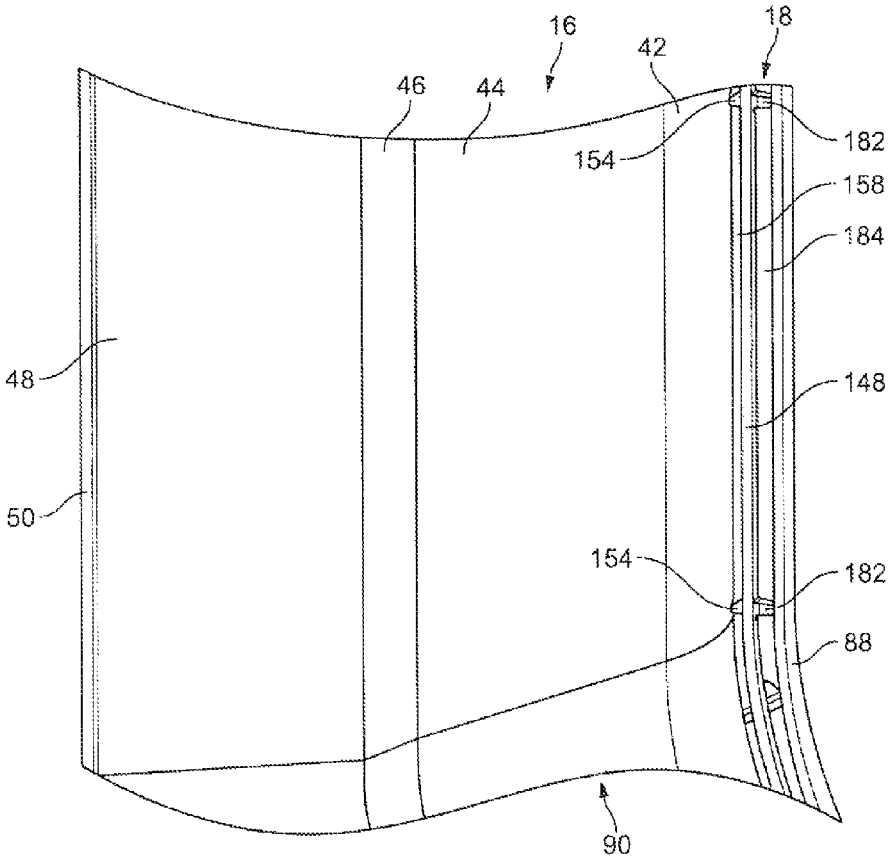
FIG. 8 is a close-up view of region Y indicated in FIG. 1.

The chassis 128 is connected to the inner surface 98 of the inner casing section 90. With reference to FIGS. 5 to 7, each of the inner walls 134 of the heater housings 130 comprises a pair of apertures 160, each aperture 160 being located at or towards a respective one of the upper and lower ends of the inner wall 134. As the chassis 128 is pushed over the rear end of the inner casing section 90, the inner walls 134 of the heater housings 130 slide over resilient catches 162 mounted on, and preferably integral with, the inner surface 98 of the inner casing section 90, which subsequently protrude through the apertures 160. The position of the chassis 128 relative to the inner casing section 90 can then be adjusted so that the inner walls 134 are gripped by the catches 162. Stop members 164 mounted on, and preferably also integral with, the inner surface 98 of the inner casing section 90 may also serve to retain the chassis 128 on the inner casing section 90.

With the chassis 128 connected to the inner casing section 90, the heater assemblies 104 are inserted into the heater housings 130 of the chassis 128, and the loom connected to the heater assemblies 104. Of course, the heater assemblies 104 may be inserted into the heater housings 130 of the chassis 128 prior to the connection of the chassis 128 to the inner casing section 90. The inner casing section 90 of the nozzle 16 is then inserted into the outer casing section 88 of the nozzle 16 so that the front end 166 of the outer casing section 88 enters a slot 168 located at the front of the inner casing section 90, as illustrated in FIG. 9. The outer and inner casing sections 88, 90 may be connected together using an adhesive introduced to the slot 168.

The outer casing section 88 is shaped so that part of the inner surface 96 of the outer casing section 88 extends around, and is substantially parallel to, the outer walls 132 of the heater housings 130 of the chassis 128. The outer walls 132 of the heater housings 130 have a front end 170 and a rear end 172, and a set of ribs 174 located on the outer side surfaces of the outer walls 132 and which extend between the ends 170, 172 of the outer walls 132. The ribs 174 are configured to engage the inner surface 96 of the outer casing section 88 to space the outer walls 132 from the inner surface 96 of the outer casing section 88. The outer walls 132 of the heater housings 130 of the chassis 128 and the outer casing section 88 thus define two third air flow channels 176. Each of the third flow channels 176 is located adjacent and extends along the inner surface 96 of the outer casing section 88. Each third flow channel 176 is separated from a respective first flow channel 136 by the outer wall 132 of the heater housing 130. Each third flow channel 176 terminates at an air outlet 178 located within the interior passage, and between the rear end 172 of the outer wall 132 of the heater housing 130 and the outer casing section 88. Each air outlet 178 is also in the form of a vertically-extending slot located within the interior passage of the nozzle 16, and preferably has a width in the range from 0.5 to 5 mm. In this example the air outlets 178 have a width of around 1 mm.

The outer casing section 88 is shaped so as to curve inwardly around part of the rear ends 148 of the inner walls 134 of the heater housings 130. The rear ends 148 of the inner walls 134 comprise a third set of spacers 182 located on the opposite side of the inner walls 134 to the second set of spacers 154, and which are arranged to engage the inner surface 96 of the outer casing section 88 to space the rear ends of the inner walls 134 from the inner surface 96 of the outer casing section 88. The outer casing section 88 and the rear ends 148 of the inner walls 134 thus define a further two air outlets 184. Each air outlet 184 is located adjacent a respective one of the air outlets 158, with each air outlet 158 being located between a respective air outlet 184 and the outer surface 92 of the inner casing section 90. Similar to the air outlets 158, each air outlet 184 is in the form of a vertically-extending slot located on a respective side of the opening 40 of the assembled nozzle 16. The air outlets 184 preferably have the same length as the air outlets 158. Each air outlet 184 preferably has a width in the range from 0.5 to 5 mm, and in this example the air outlets 184 have a width of around 2 to 3 mm. Thus, the air outlets 18 for emitting the primary air flow from the fan assembly 10 comprise the two air outlets 158 and the two air outlets 184.

Returning to FIGS. 3 and 4, the nozzle 16 preferably comprises two curved sealing members 186, 188 each for forming a seal between the outer casing section 88 and the inner casing section 90 so that there is substantially no leakage of air from the curved sections 94*c*, 94*d* of the interior passage of the nozzle 16. Each sealing member 186, 188 is sandwiched between two flanges 190, 192 located within the curved sections 94*c*, 94*d* of the interior passage. The flanges 190 are mounted on, and preferably integral with, the inner casing section 90, whereas the flanges 192 are mounted on, and preferably integral with, the outer casing section 88. As an alternative to preventing the air flow from leaking from the upper curved section 94*c* of the interior passage, the nozzle 16 may be arranged to prevent the air flow from entering this curved section 94*c*. For example, the upper ends of the straight sections 94*a*, 94*b* of the interior passage may be blocked by the chassis 128 or by inserts introduced between the inner and outer casing sections 88, 90 during assembly.

To operate the fan assembly 10 the user presses button 24 of the user interface, or presses a corresponding button of the remote control 35 to transmit a signal which is received by the sensor of the user interface circuit 33. The user interface control circuit 33 communicates this action to the main control circuit 52, in response to which the main control circuit 52 activates the motor 68 to rotate the impeller 64. The rotation of the impeller 64 causes a primary air flow to be drawn into the body 12 through the air inlet 14. The user may control the speed of the motor 68, and therefore the rate at which air is drawn into the body 12 through the air inlet 14, by pressing button 26 of the user interface or a corresponding button of the remote control 35. Depending on the speed of the motor 68, the primary air flow generated by the impeller 64 may be between 10 and 30 liters per second. The primary air flow passes sequentially through the impeller housing 76 and the open upper end of the main body portion 22 to enter the lower curved section 94*d* of the interior passage of the nozzle 16. The pressure of the primary air flow at the outlet 23 of the body 12 may be at least 150 Pa, and is preferably in the range from 250 to 1.5 kPa.

The user may optionally activate the heater assemblies 104 located within the nozzle 16 to raise the temperature of the first portion of the primary air flow before it is emitted from the fan assembly 10, and thereby increase both the temperature of the primary air flow emitted by the fan assembly 10 and the temperature of the ambient air in a room or other environment in which the fan assembly 10 is located. In this example, the heater assemblies 104 are both activated and de-activated simultaneously, although alternatively the heater assemblies 104 may be activated and de-activated separately. To activate the heater assemblies 104, the user presses button 30 of the user interface, or presses a corresponding button of the remote control 35 to transmit a signal which is received by the sensor of the user interface circuit 33. The user interface control circuit 33 communicates this action to the main control circuit 52, in response to which the main control circuit 52 issues a command to the heater control circuit 124 to activate the heater assemblies 104. The user may set a desired room temperature or temperature setting by pressing button 28 of the user interface or a corresponding button of the remote control 35. The user interface circuit 33 is arranged to vary the temperature displayed by the display 34 in response to the operation of the button 28, or the corresponding button of the remote control 35. In this example, the display 34 is arranged to display a temperature setting selected by the user, which may correspond to a desired room air temperature. Alternatively, the display 34 may be arranged to display one of a number of different temperature settings which has been selected by the user.

Within the lower curved section 94*d* of the interior passage of the nozzle 16, the primary air flow is divided into two air streams which pass in opposite directions around the opening 40 of the nozzle 16. One of the air streams enters the straight section 94*a* of the interior passage located to one side of the opening 40, whereas the other air stream enters the straight section 94*b* of the interior passage located on the other side of the opening 40. As the air streams pass through the straight sections 94*a*, 94*b*, the air streams turn through around 90° towards the air outlets 18 of the nozzle 16. To direct the air streams evenly towards the air outlets 18 along the length of the straight section 94*a*, 94*b*, the nozzle 16 may comprises a plurality of stationary guide vanes located within the straight sections 94*a*, 94*b* and each for directing part of the air stream towards the air outlets 18. The guide vanes are preferably integral with the internal surface 98 of the inner casing section 90. The guide vanes are preferably curved so that there is no significant loss in the velocity of the air flow as it is directed towards the air outlets 18. Within each straight section 94*a*, 94*b*, the guide vanes are preferably substantially vertically aligned and evenly spaced apart to define a plurality of passageways between the guide vanes and through which air is directed relatively evenly towards the air outlets 18.

As the air streams flow towards the air outlets 18, a first portion of the primary air flow enters the first air flow channels 136 located between the walls 132, 134 of the chassis 128. Due to the splitting of the primary air flow into two air streams within the interior passage, each first air flow channel 136 may be considered to receive a first portion of a respective air stream. Each first portion of the primary air flow passes through a respective heating assembly 104. The heat generated by the activated heating assemblies is transferred by convection to the first portion of the primary air flow to raise the temperature of the first portion of the primary air flow.

A second portion of the primary air flow is diverted away from the first air flow channels 136 by the front ends 146 of the inner walls 134 of the heater housings 130 so that this second portion of the primary air flow enters the second air flow channels 156 located between the inner casing section 90 and the inner walls of the heater housings 130. Again, with the splitting of the primary air flow into two air streams within the interior passage each second air flow channel 156 may be considered to receive a second portion of a respective air stream. Each second portion of the primary air flow passes along the internal surface 92 of the inner casing section 90, thereby acting as a thermal barrier between the relatively hot primary air flow and the inner casing section 90. The second air flow channels 156 are arranged to extend around the rear wall 150 of the inner casing section 90, thereby reversing the flow direction of the second portion of the air flow, so that it is emitted through the air outlets 158 towards the front of the fan assembly 10 and through the opening 40. The air outlets 158 are arranged to direct the second portion of the primary air flow over the external surface 92 of the inner casing section 90 of the nozzle 16.

A third portion of the primary air flow is also diverted away from the first air flow channels 136. This third portion of the primary air flow by the front ends 170 of the outer walls 132 of the heater housings 130 so that the third portion of the primary air flow enters the third air flow channels 176 located between the outer casing section 88 and the outer walls 132 of the heater housings 130. Once again, with the splitting of the primary air flow into two air streams within the interior passage each third air flow channel 176 may be considered to receive a third portion of a respective air stream. Each third portion of the primary air flow passes along the internal surface 96 of the outer casing section 88, thereby acting as a thermal barrier between the relatively hot primary air flow and the outer casing section 88. The third air flow channels 176 are arranged to convey the third portion of the primary air flow to the air outlets 178 located within the interior passage. Upon emission from the air outlets 178, the third portion of the primary air flow merges with this first portion of the primary air flow. These merged portions of the primary air flow are conveyed between the inner surface 96 of the outer casing section 88 and the inner walls 134 of the heater housings to the air outlets 184, and so the flow directions of these portions of the primary air flow are also reversed within the interior passage. The air outlets 184 are arranged to direct the relatively hot, merged first and third portions of the primary air flow over the relatively cold second portion of the primary air flow emitted from the air outlets 158, which acts as a thermal barrier between the outer surface 92 of the inner casing section 90 and the relatively hot air emitted from the air outlets 184. Consequently, the majority of the internal and external surfaces of the nozzle 16 are shielded from the relatively hot air emitted from the fan assembly 10. This can enable the external surfaces of the nozzle 16 to be maintained at a temperature below 70° C. during use of the fan assembly 10.

The primary air flow emitted from the air outlets 18 passes over the Coanda surface 42 of the nozzle 16, causing a secondary air flow to be generated by the entrainment of air from the external environment, specifically from the region around the air outlets and from around the rear of the nozzle. This secondary air flow passes through the opening 40 of the nozzle 16, where it combines with the primary air flow to produce an overall air flow projected forward from the fan assembly 10 which has a lower temperature than the primary air flow emitted from the air outlets 18, but a higher temperature than the air entrained from the external environment. Consequently, a current of warm air is emitted from the fan assembly 10.

As the temperature of the air in the external environment increases, the temperature of the primary air flow drawn into the fan assembly 10 through the air inlet 14 also increases. A signal indicative of the temperature of this primary air flow is output from the thermistor 126 to the heater control circuit 124. When the temperature of the primary air flow is above the temperature set by the user, or a temperature associated with a user's temperature setting, by around 1° C., the heater control circuit 124 de-activates the heater assemblies 104. When the temperature of the primary air flow has fallen to a temperature around 1° C. below that set by the user, the heater control circuit 124 re-activates the heater assemblies 104. This can allow a relatively constant temperature to be maintained in the room or other environment in which the fan assembly 10 is located.

The invention claimed is:

1. A fan assembly comprising:

a system for creating an air flow;

a heating arrangement for heating a first portion of the air flow;

at least one air diverting surface for diverting a second portion of the air flow away from the heating arrangement; and a casing comprising a plurality of air outlets for emitting the air flow from the casing, the casing having an annular external surface defining an opening through which air from outside the casing is drawn by the air flow emitted from the air outlets;

wherein the plurality of air outlets comprises at least one first air outlet for emitting the first portion of the air flow through the opening and at least one second air outlet for emitting the second portion of the air flow through the opening;

wherein said at least one second air outlet is arranged to direct the second portion of the air flow over said external surface of the casing, and said at least one first air outlet is arranged to direct the first portion of the air flow over the second portion of the air flow.

2. The fan assembly of claim 1, wherein said at least one air diverting surface comprises at least one wall for diverting the second portion of the air flow away from the heating arrangement.

3. The fan assembly of claim 1, comprising a chassis for retaining the heating arrangement within the fan assembly, and wherein the chassis comprises said at least one air diverting surface.

4. The fan assembly of claim 1, wherein the casing comprises at least one first channel for conveying the first portion of the air flow to said at least one first air outlet, at least one second channel for conveying the second portion of the air flow to said at least one second air outlet, and at least one separating wall for separating said at least one first channel from said at least one second channel.

5. The fan assembly of claim 4, wherein said at least one separating wall is integral with said at least one air diverting surface.

6. The fan assembly of claim 4, wherein the casing comprises an inner casing section and an outer casing section surrounding the inner casing section, and wherein said at least one separating wall is located between the casing sections.

7. The fan assembly of claim 6, wherein said at least one separating wall is connected to one of the casing sections.

8. The fan assembly of claim 1, wherein said at least one first air outlet comprises a plurality of first air outlets, and said at least one second air outlet comprises a plurality of second air outlets.

9. The fan assembly of claim 8, wherein the air flow is divided into a plurality of air stream, each air stream comprises a respective first portion and a respective second portion of the air flow.

10. The fan assembly of claim 9, wherein the casing comprises, for each air stream, a first channel for conveying the first portion of the air stream to a respective first air outlet, a second channel for conveying the second portion of the air stream to a respective second air outlet, and a separating wall for separating the first channel from the second channel.

11. The fan assembly of claim 10, wherein the wall is integral with at least one air diverting surface.

12. The fan assembly of claim 10, wherein the casing comprises an inner casing section and an outer casing section surrounding the inner casing section, and wherein the wall is located between the casing sections.

13. The fan assembly of claim 12, wherein the wall is connected to one of the casing sections.

14. The fan assembly of claim 12, wherein each first air outlet is located between an internal surface of the outer casing section and a respective wall.

15. The fan assembly of claim 12, wherein each second air outlet is located between an external surface of the inner casing section and a respective wall.

16. The fan assembly of claim 12, wherein the second channel is arranged to convey the second portion of the air flow along an internal surface of one of the casing sections.

17. The fan assembly of claim 12, wherein the wall comprises a plurality of spacers for engaging at least one of the inner casing section and the outer casing section.

18. The fan assembly of claim 12, wherein each of the first channel and the second channel means is shaped so as substantially to reverse the flow direction of a respective portion of the air flow.

19. The fan assembly of claim 8, wherein the first air outlets are located on opposite sides of the casing.

20. The fan assembly of claim 8, wherein the second air outlets are located on opposite sides of the casing.

21. The fan assembly of claim 9, wherein the heating arrangement comprises a plurality of heater assemblies each for heating a respective first portion of the air flow.

22. The fan assembly of claim 21, wherein the heater assemblies are located on opposite sides of the casing.

23. The fan assembly of claim 21, wherein said at least one air diverting surface comprises a plurality of walls each for diverting a respective second portion of the air flow away from a heater assembly.

24. The fan assembly of claim 1, wherein the heating arrangement is located within the casing.

25. The fan assembly of claim 19, wherein said at least one air diverting surface is located within the casing.

26. The fan assembly of claim 1, comprising a base housing the system for creating the air flow, and wherein the casing is connected to the base.

27. The fan assembly of claim 1, wherein said at least one first air outlet is located adjacent said at least one second air outlet.

28. The fan assembly of claim 1, wherein each air outlet is in the form of a slot.

29. The fan assembly of claim 28, wherein each air outlet has a width in the range from 0.5 to 5 mm.

30. The fan assembly of claim 1, wherein the heating arrangement comprises at least one ceramic heater.

* * * * *